US009014412B2

(12) United States Patent
Humphreys et al.

(10) Patent No.: US 9,014,412 B2
(45) **Date of Patent: *Apr. 21, 2015**

(54) LOUDSPEAKER THAT IS AXIALLY STABILIZED OUT OF THE DIAPHRAGM SUSPENSION PLANE

(71) Applicant: Aperion Audio, Inc., Portland, OR (US)

(72) Inventors: Ken Humphreys, Eugene, OR (US); Michael Hopkins, Portland, OR (US); Nathan Thomas, Tualatin, OR (US)

(73) Assignee: Aperion Audio, Inc., Portland, OR (US)

( * ) Notice: Subject to any disclaimer, the term of this patent is extended or adjusted under 35 U.S.C. 154(b) by 18 days.

This patent is subject to a terminal disclaimer.

(21) Appl. No.: 13/867,068

(22) Filed: Apr. 20, 2013

(65) Prior Publication Data

US 2013/0233640 A1 Sep. 12, 2013

Related U.S. Application Data

(63) Continuation-in-part of application No. 12/833,443, filed on Jul. 9, 2010, now Pat. No. 8,428,295.

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 9/04*** | (2006.01) |
| ***H04R 7/12*** | (2006.01) |
| *H04R 9/02* | (2006.01) |

(52) U.S. Cl.

CPC .. *H04R 9/04* (2013.01); *H04R 9/02* (2013.01); *H04R 9/06* (2013.01); *H04R 7/122* (2013.01)

(58) Field of Classification Search

CPC ..... H04R 9/00; H04R 9/02; H04R 9/06; H04R 7/122

USPC ..... 381/396–433

See application file for complete search history.

(56) References Cited

U.S. PATENT DOCUMENTS

| | | | | |
|---|---|---|---|---|
| 4,399,334 | A | 8/1983 | Kakiuchi et al. | |
| 5,157,731 | A | 10/1992 | Mitobe | |
| 5,537,481 | A | 7/1996 | Voishvillo | |
| 5,875,252 | A | 2/1999 | Lesage | |
| 5,903,076 | A * | 5/1999 | Suyama | 310/81 |
| 6,320,972 | B1 | 11/2001 | Goller | |
| 6,513,523 | B1 | 2/2003 | Izuchukwu et al. | |
| 8,428,295 | B2 * | 4/2013 | Humphreys | 381/400 |
| 2008/0013781 | A1 | 1/2008 | Sagren | |

* cited by examiner

*Primary Examiner* — Ahmad F Matar
*Assistant Examiner* — Katherine Faley
(74) *Attorney, Agent, or Firm* — Howard Russell

(57) ABSTRACT

An improved mid to high-frequency loudspeaker of the type having a central dome diaphragm having an outer periphery, and in one embodiment an outer ring-radiator diaphragm portion defining an inner periphery and an outer periphery, the ring-radiator diaphragm being attached at its inner periphery to an armature voice coil assembly and at its outer periphery to a diaphragm chassis in a first plane. The central diaphragm portion is attached at its outer periphery to either the inner periphery of the outer ring-radiator diaphragm or the voice coil armature, and the improvement comprises axially-located stabilizing means attached to the central diaphragm portion, or alternatively a central stabilizing framework, in a second plane parallel to the first plane and that is of sufficient distance from the first plane to provide leverage sufficient to stabilize the diaphragm to minimize rocking, allow improved alignment of the voice coil allowing tighter tolerances between the voice coil and magnet assembly, thus improving performance and minimizing distortion.

8 Claims, 24 Drawing Sheets

LOUDSPEAKER THAT IS AXIALLY STABILIZED OUT OF THE DIAPHRAGM SUSPENSION PLANE

This application is a continuation-in-part of U.S. patent application Ser. No. 12/833,443, filed Jul. 9, 2010, for Loudspeaker That Is Axially Stabilized Out Of The Diaphragm Suspension Plane (hereafter referred to as the Parent application). This application claims the benefit of the priority date of the Parent application and applicant disclaims any terminal period of any patent issuing on the present application that extends beyond 20 years from the priority date of any patent issuing on the Parent application.

BACKGROUND OF INVENTION

The present invention relates to improvement of performance of loudspeakers in general and specifically to stabilization of loudspeakers operating within the mid to high-frequency range and having a magnet system and voice coil connected to a diaphragm.

Referring to Prior Art FIG. 1*a*, in a conventional tweeter-type, sometimes referred to as a dome type, loudspeaker there is a half-circular (in cross-section) outer-ring diaphragm portion 2 and a semi-circular (in cross-section) inner-dome diaphragm portion 4, residing within the diameter of the outer ring. Attachment location 12, 20 illustrates how the outer-ring diaphragm portion 2 is connected, as with gluing for example, near the outer circumference of the outer ring to the diaphragm chassis 5. Attachment location 14, 18 illustrates where the outer-ring diaphragm portion 2 is interconnected, as with gluing for example, near the inner circumference of the outer-ring portion 2 and near the outer circumference of inner-dome diaphragm portion 4 by means of a cylindrical, annular armature 22 upon which is wound the voice coil winding 24 and which are free to vibrate between a top plate 28 and yoke 30 of the speaker. As is conventional, the top plate 28 and yoke 30 have a magnet 32 between them in sandwich construction as shown. Magnetic energy is transferred by the top plate 28 and yoke 30 from the magnet 32 to the voice coil gap between the top plate and yoke. Attachment locations 12, 14, 18, 20 of the dome-type loudspeaker diaphragm have lied in a single plane.

Similarly, as shown in FIG. 1*b*, the attachment points 12, 14, 16, 18, 20 of another conventional ring-radiator type loudspeaker diaphragm have lied in a single plane, additional attachment location 16 serving to connect a center portion of diaphragm portion 4 with a center post 26. Thus, FIG. 1*b* illustrates another type of tweeter loudspeaker, wherein the central diaphragm portion 4 includes an inner ring and not a dome as shown in FIG. 1*a*.

As the described conventional speakers' diaphragm portions 2, 4 are operated through their range of motion, the voice coil 24 is motivated along a typically, and preferably, linear path by fluctuations in the magnetic field representing the sound signals being transduced and to which the voice coil 24 is exposed. However, traditional limitations of speaker systems, such as magnetic flux variations in the permanent magnet 32, variances in gap widths between the top magnetic plate 28 and the yoke 30, and electronic magnetic flux variations in the voice coil 24 due to such things as manufacturing imperfections in voice coil windings and their materials, have all resulted in an imbalanced application of force to the diaphragm portions 2, 4. All of these factors and others have contributed to the diaphragm moving and tilting off of its axial center, especially at resonant frequencies where the speaker presents the greatest impedance to power applied to the voice coil. This condition, sometimes referred to as rocking, distorts speaker output. This rocking condition is illustrated in FIGS. 2*a*-2*c*, wherein FIG. 2*a* shows the diaphragm portions 2, 4 and voice coil 24 at rest, FIG. 2*b* shows the diaphragm portions 2, 4 and voice coil 24 at full excursion, their furthest travel distance during operation, and FIG. 2*c* shows the diaphragm portions 2, 4 and voice coil 24 in a rocked condition most easily seen in that the armature 22 and voice coil 24 are shown slightly tilted between the top plate 28 and the yoke 30. It will be appreciated by those of ordinary skill in the art that the rocked condition shown in FIG. 2*c*, and the full excursion of FIG. 2*b*, are exaggerated to allow visual illustration of these conditions of full excursion and rocking, whereas actual excursion and rocking vibrations are on a much smaller scale not readily visible to the human eye.

It is largely accepted in the industry that rocking contributes to distortion in speaker output, especially at the speaker's fundamental resonant frequency. As design and manufacturing improvements yield higher performing speakers having tighter tolerances between the yoke 30 and top plate 28, severe rocking, most likely to occur in the lower frequency ranges of a mid to high range dome-type speaker, becomes more intolerable, as it would degrade speaker performance and speaker life.

Referring to FIG. 1*b*, though there is an attachment of the inner ring of the diaphragm at location or point 16, due to the planar nature of the attachment, rocking still persists with this speaker design. FIG. 2*d* illustrates this type of speaker of FIG. 1*b* at rest, and FIG. 2*e* shows, again in exaggerated condition for purposes of illustration, the loudspeaker of FIG. 1*b* in an out-of-axis, rocked, condition.

While casual listeners may not notice distortion resulting from rocking, any person who is especially interested in high-fidelity sound reproduction finds technical measurements to be important and decisive. Further, there is an increasing desire in speaker design and manufacturing circles to improve low frequency response of tweeter and mid-range speakers especially at resonant frequencies. Alternatively, speaker providers desire lower resonant frequencies which increase the frequency range in which a speaker is available to operate without overcoming severe impedance abnormalities at resonant frequency. Increasing the size of the annular ring radiator portion of a dome-type speaker to accomplish such lower frequency response has exacerbated rocking in such speakers.

SUMMARY OF THE INVENTION

In accordance with the invention, there is provided an improved loudspeaker comprising a face plate that defines an opening for a speaker central diaphragm portion having an inner surface and an outer surface, a central area and an outer periphery. The speaker further comprises a diaphragm chassis, top plate, magnet, yoke, voice coil armature, the top plate and yoke defining an annular air gap for the voice coil armature winding. The central diaphragm portion is attached in a first plane along its outer periphery to the armature. The improvement comprises: attachment means depending from the speaker chassis, the attachment means attached closely adjacent the central area of the central diaphragm portion in a second plane parallel to the first plane and that is of sufficient distance from the first plane to provide out-of-axis movement resistance sufficient to stabilize the diaphragm against rocking.

In accordance with an embodiment of the invention, the aforementioned attachment means further comprises a stabilizing member having a proximal end and a distal end. The distal end of the stabilizing member is attached to the face plate, and the proximal end of the stabilizing member is attached to the central diaphragm portion.

In accordance with another embodiment of the invention, a bridge member depends from the face plate and completely spans the circular opening in which the central diaphragm portion resides. With this embodiment of the invention, the distal end of the stabilizing member is attached to the bridge member and the proximal end of the stabilizing member is attached to the central diaphragm portion. Preferably, the attachment means is fixed to the central diaphragm portion by gluing. However, it will be appreciated that other means of interconnecting the attachment means may be employed without departing from the true scope and spirit of the invention.

For example, alternatively, an improved loudspeaker in accordance with another embodiment of the invention is provided wherein the attachment means further comprises a T-shaped head member having a shaft portion and a cap portion defining proximal and distal surfaces. In accordance with this embodiment of the invention, the stabilizing member defines an opening adapted for receiving the shaft portion of the T-shaped head member and the proximal end of the stabilizing member engages the outer surface of the central diaphragm portion. The proximal surface of the cap portion preferably engages the inner surface of the central diaphragm portion.

In another embodiment, the attachment means further comprises an interior axially-located support member having proximal and distal ends, the interior axially-located support member depending at its distal end from one of the yoke and the speaker chassis, and the proximal end of the interior axially-located support member engaging the interior surface of the central diaphragm adjacent the center point where the proximal end of the stabilizing member is attached to the central diaphragm.

In the aforementioned embodiments of the invention, the central diaphragm portion may preferably have a slightly recessed area, or dimple to form a dimpled portion of the diaphragm, and the central diaphragm is stabilized against rocking by a small, narrowly constructed, exterior axially-located stabilizer member, such as a post, preferably depending from the bridge member and further supported by the interior axially-located stabilizing member, or post, both to which the central, preferably recessed, area of the diaphragm may be fixed as with gluing and sandwich construction. This means of providing a mounted stabilization point in a second plane that is parallel but significantly distant from the first plane of the attachment of the outer periphery of the diaphragm to the diaphragm chassis has several benefits as further described below.

Moving out of the plane of the suspension of the diaphragm the attachment point of the axial portion of the central diaphragm portion has the benefit of reducing rocking of the speaker diaphragm since the immobilization of the diaphragm's central axial attachment point offers resistance to lateral displacement and reduces the tendency of the diaphragm to roll or rock off of its axis, thus reducing the distortion of such a speaker and improving the sound quality of the speaker. Further, displacement of the central axial attachment point, or displaced attachment, is conducive to a form of attachment employing a bridge and post stabilization means that not only provides an attractive appearance for the speaker but also provides for some protection of the diaphragm against impact damage. Thus, while a bridge support for the exterior axially-aligned stabilizer member is preferred, those of ordinary skill in the art will realize that the bridge support may also be accomplished with a cantilevered support member as well.

Another advantage of such out-of-plane stabilization is the allowance of a tighter tolerance gap between the top plate and the yoke to allow higher fidelity transduction with less power required to the speaker. By stabilizing against rocking, such out-of-plane stabilization in accordance with the invention could prevent wear and tear on the voice coil that could occur, especially at resonant frequency, if the speaker were manufactured with tighter tolerance gap widths between the magnet and the yoke.

In accordance with another aspect of the invention, an improved loudspeaker having an outer ring-radiator-type diaphragm is provided. In this embodiment of the invention, there is provided a diaphragm chassis, top plate, magnet, yoke, voice coil armature. The top plate and yoke define an annular air gap for the voice coil wound on the armature. A face plate defines an opening for a central speaker diaphragm portion having inner and outer surfaces, a central area and an outer periphery. The speaker's outer annular arch-profiled strip diaphragm portion has an outer periphery and an inner periphery. The central diaphragm portion is attached along its outer periphery and in a first plane to one of the armature and the inner periphery of the outer diaphragm portion, and the outer periphery of the outer diaphragm portion is attached to the diaphragm chassis in the same first plane. The improvement provided by this aspect of the invention comprises: attachment means depending from the speaker chassis, the attachment means being attached closely adjacent the central point of the central diaphragm portion in a second plane parallel to the first plane and that is of sufficient distance from the first plane to provide out-of-axis movement resistance sufficient to stabilize the diaphragm against rocking.

This aspect of the invention facilitates development of improved lower frequency response in mid to high-range tweeter-type speakers by reducing rocking especially at resonant frequencies of such speakers. Since, with the present invention, rocking is reduced by out-of-plane axial stabilization of the speaker's dome-type diaphragm, a larger ring radiator portion of the speaker is permitted without concern for undue rocking. In turn, this enables higher fidelity lower frequency response from mid-range to high-frequency speakers.

In accordance with another embodiment of the invention, the attachment means further comprises a stabilizing member having a proximal end and a distal end, the distal end of the stabilizing member being attached to the face plate and the proximal end of the stabilizing member being attached to the central diaphragm portion. This embodiment of the invention provides for a cantilevered stabilizing member in a ring-radiator-type central dome diaphragm speaker.

Alternatively, a bridge member depending from the face plate and completely spanning the circular opening in which the diaphragm resides may be provided. In this case, the distal end of the stabilizing member is attached to the bridge member and the proximal end of the stabilizing member is attached to the central diaphragm portion. These alternative embodiments of the invention share the same benefits as the first and second aspects of the invention described above regarding reduced rocking, allowance of tighter gap tolerances and facilitation of higher fidelity lower frequency response from a mid-range to high-frequency speaker. As with the first aspect of the invention, the attachment means may be preferably fixed to the central diaphragm portion of the speaker by gluing.

In an alternative embodiment of the invention, alternative attachment means is provided further comprising a T-shaped head member having a shaft portion and a cap portion defining proximal and distal surfaces. In this case the stabilizing member defines an opening adapted for receiving the shaft portion of the T-shaped head member, the proximal end of the stabilizing member engaging the outer surface of the central diaphragm portion and the proximal surface of the cap portion engaging the inner surface of the central diaphragm portion.

In yet another embodiment of this second aspect of the invention, the attachment means further comprises an interior axially-located support member having proximal and distal ends, the interior axially-located support member depending at its distal end from one of the yoke and the speaker chassis, the proximal end of the interior axially-located support member engaging the interior surface of the central diaphragm adjacent the center point where the proximal end of the stabilizing member is attached to the central diaphragm.

In accordance with another aspect of the invention, an axially-located collar is provided encircling the proximal portion of the internal axially-located stabilizer member and a radially extending stabilizer member is attached to and around the periphery of the collar. The radially-extending stabilizer member extends radially outwardly from the collar to attachment locations on one of the armature and the inner periphery of the outer annular arch-profiled strip diaphragm portion. The interior axially-located stabilizer member, the collar and the radially extending stabilizer member act jointly to reduce translation of the radially-extending stabilizer member and arch-profile strip diaphragm, except for a minimal distance corresponding to speaker diaphragm excursion along the loudspeaker axis. The collar encircles the proximal portion of the internally axially-located stabilizer member in a second plane parallel to the first plane and at a location a sufficient distance from the first plane to provide resistance to lateral displacement of the annular arch-profiled strip diaphragm portion sufficient to stabilize the diaphragm against rocking.

In accordance with this aspect of the invention, the central stabilizing member may be comprised of either a diaphragm or some other stabilizing structural member for stabilizing the speaker diaphragm, and the second plane for attachment of the stabilizing member where the collar thereof is found encircling the proximal portion of the axially-located stabilizer member may even be provided rearward of the first plane where the diaphragm is attached to the armature and the speaker chassis. The collar may be slidably engaged with the proximal portion of the internal axially-located stabilizer member, or otherwise held in close proximity to the axial stabilizing member.

Thus, in accordance with this aspect of the invention, it is understood that a primary source of sound for the speaker comes from the outer ring radiator portion of the speaker, so that a more rigid cone structure, or even a stabilizing framework structure, could be used to stabilize the speaker diaphragm.

Where the radially extending support member comprises a central diaphragm, the central diaphragm defines an axial opening, the edge of the opening being the collar that is located in the second plane parallel to the first plane as described. The central diaphragm portion comprises an interior surface and an exterior surface and an outer periphery, the central diaphragm portion being attached along the outer periphery of the central diaphragm portion to one of the armature and the inner periphery of the outer annular arch-profiled strip diaphragm portion in the first plane.

In the case of a sufficiently flexible material diaphragm, the central diaphragm may be glued near its axial opening to the proximal portion of the internal axially-located stabilizer member. Or, alternatively, other attachment means is provided for attaching the central diaphragm to the internal axially-located stabilizer member. Such attachment means may further comprise a T-shaped head member having shaft and a cap defining proximal and distal surfaces. The internal axially-located stabilizing member in this embodiment defines an opening adapted for receiving the shaft of the T-shaped head member, and the proximal end of the internal axially-located stabilizing member engages the inner surface of the central diaphragm, while the proximal surface of the cap engages the outer surface of the central diaphragm.

As with other aspects and embodiments of the invention, there is provided with this aspect of the invention an embodiment further comprising a bridge member depending from the face plate and spanning the opening therein. In such case the attachment means further comprises an exterior axially-located stabilizer member having proximal and distal ends, the exterior axially-located stabilizer member depending at its distal end from the bridge member. In this embodiment, the proximal end of the internal axially-located stabilizer member defines a narrowed neck portion passing through the axial opening, or collar, in the central diaphragm, or stabilizing support structure, and it is attached to the proximal end of the external axially-located stabilizer member.

In accordance with this aspect of the invention, the radially-extending stabilizer member may preferably comprise an axially-flexible diaphragm which allows some flex along the axis of the speaker but which resists stretching, flexing, or translation perpendicular to the axis of the speaker so as to prevent translation associated with rocking.

Further, it will be understood by those of ordinary skill in the art that the collar of this alternate embodiment of the invention resists non-axial translation of the radially-extending stabilizer member, and hence the outer ring diaphragm, but is allowed to translate axially along the internal axially-located stabilizer member.

It will be further appreciated that with this alternate embodiment of the invention, the location of the collar is located in a plane that is forward or aft (rearward) of the voice-coil-armature-diaphragm attachment plane.

In accordance with another embodiment of the invention, there is provided an improved loudspeaker comprising diaphragm chassis, top plate, magnet, yoke and a voice coil armature. The top plate and yoke define an annular air gap for the voice coil armature. This embodiment of the improved loud speaker further comprises a face plate comprising an inner periphery defining an opening for a speaker diaphragm having a central portion having inner and outer surfaces, a central area and an outer periphery, and an outer annular arch-profiled strip diaphragm portion having an outer periphery and an inner periphery. The central diaphragm portion is attached along the outer periphery of the central diaphragm portion to one of the voice coil armature and the inner periphery of the outer diaphragm portion. The outer periphery of the outer diaphragm portion is attached to the diaphragm chassis in a first plane. The improvement comprises: a bridge member that at least partially spans the opening in the face plate and comprising a plurality of forwardly arched extension members interconnecting at a central intersection forward of the central portion of the speaker diaphragm. Each extension member depends from an attachment location on the face plate periphery defining the opening and that is equidistant from a next attachment location of an extension member around the periphery of the face plate. The loudspeaker further comprises a ring-shaped support member centered forward of the center of the central portion of the speaker diaphragm, the ring-shaped support member interconnecting the plurality of extension members at an intermediate location along each of the extension members. The loudspeaker further comprises a stabilizing member having a proximal portion and a distal portion, the distal portion of the stabilizing member being attached to the central intersection location of the extension members of the bridge member and the proximal portion of the stabilizing member being attached to the center of the central diaphragm portion in a second plane parallel to the first plane and that is of sufficient distance from the first plane to provide out-of-axis movement resistance sufficient to stabilize the diaphragm against rocking.

The opening defined by the inner periphery of the face plate of the loudspeaker in accordance with this embodiment of the invention is preferably circular, and the bridge member preferably comprises three extension members each of equal length and depending from equidistant attachment locations around the periphery of a opening formed by the face plate.

Further, in accordance with this embodiment of the invention, the central diaphragm portion preferably comprises an inner surface, an outer surface and a central opening, and preferably the stabilizing member comprises an axially central, stepped-down post having a first circular cross-section larger diameter for interconnecting between the bridge member and a portion of the outer surface of the central diaphragm portion and a second circular cross-section smaller diameter for extending through the central opening in the central diaphragm portion.

Further, in accordance with this embodiment of the invention, the first circular cross-section larger diameter post of the stabilizing member preferably tapers outwardly in circular cross-section from the circular central intersection of the stabilizing member with the bridge to the circular central intersection of the stabilizing member with the outer surface of the central diaphragm portion. Still further, preferably a cross-section of the ring-shaped support member has a forward-most wide surface and tapers rearwardly and inwardly to a rear-most narrow surface, or point, thus forming a generally v-shaped cross-section which comprises at least an outer taper line which aligns with the circular cross-section intersection of the stabilizing member with the outer surface of the central diaphragm portion. This embodiment of the invention thus provides the bridge and stabilizing member combination not only with structural strength but the converging inwardly-tapering outer ring-shaped support and outwardly tapering axially-central stabilizing member provides an aesthetically pleasing visual appearance to this embodiment of the invention.

In accordance with another embodiment of the invention, the stabilizing or stabilization member of the loudspeaker further comprises an interior axially-located and star-shaped support member having proximal and distal ends, having integral support ribs and a base. Further, the interior axially-located support member is attached at the interior axially-located support member's distal end to the base, the base depends from the yoke, and the proximal end of the interior axially-located support member engages the interior surface of the central diaphragm portion adjacent the center location where the proximal end of the stabilizing member is attached to the central diaphragm.

These embodiments of the invention illustrate yet another way of providing for a stabilizing member depending from a bridge member and that is attached to the center of the diaphragm of the loudspeaker in a plane that is sufficiently different, preferably forward, from the outer attachment plane of the periphery of the ring radiator portion of the diaphragm so as to help prevent rocking of the speaker. The bridge member not only protects the diaphragm from being bumped, as with a vacuum cleaner, book or other device, but it also lends to the aesthetics of the loud speaker. The circular ring-shaped support member further strengthens the bridge against collapse or from otherwise being compromised.

In accordance with yet another embodiment and aspect of the invention, there is provided an improved loudspeaker comprising diaphragm chassis, top plate, magnet, yoke and a voice coil armature. The top plate and yoke define an annular air gap for the voice coil armature, and the loudspeaker further comprises a face plate having an inner periphery defining an opening for a speaker diaphragm having a central portion having an inner surface and an outer surface, a central area and an outer periphery. The diaphragm of the loudspeaker further comprises an outer annular arch-profiled strip diaphragm portion having an outer periphery and an inner periphery. The central diaphragm portion is attached along the outer periphery of the central diaphragm portion to one of the voice coil armature and the inner periphery of the outer diaphragm portion. The outer periphery of the outer diaphragm portion is attached to the diaphragm chassis in a first plane. The improvement comprises: a bridge member comprising a plurality of forwardly arched extension members interconnected at a central intersection location forward of the central portion of the speaker diaphragm, each extension member depending from an attachment location on the face plate periphery defining the opening, and the bridge member at least partially spans the opening defined by the face plate for the speaker diaphragm. The loudspeaker further comprises a centrally located member having a forward pointed end and an aft base portion, the centrally located member being attached to the bridge member at the central intersection location of the extension members and adjacent the aft base portion of the centrally located member. The loudspeaker further comprises an interior axially-located stabilizing member comprising a proximal end and a distal end, the distal end of the stabilizing member being attached to the yoke, and the proximal end engaging the interior surface of the central diaphragm portion at the center of the central diaphragm where the proximal end of the stabilizing member is attached to the central diaphragm in a second plane parallel to the first plane and that is of sufficient distance from the first plane to provide out-of-axis movement resistance sufficient to stabilize the diaphragm against rocking.

Preferably, the opening defined by the inner periphery of the face plate of the speaker of this aspect of the invention is circular and the bridge member comprises two y-shaped extension members, each y-shaped extension member comprising two outer legs terminating with attachment ends and an inner leg having an attachment area. Each y-shaped extension member depends at the outer attachment ends from attachment locations on the periphery of the face plate defining the opening for the speaker diaphragm, and each y-shaped extension member is interconnected to the other y-shaped extension member (preferably the two y-shaped members are a single integral bridge unit) at the inner attachment area of each extension member. The inner legs of the y-shaped extension members form a portion of the bridge that is linear and passes over, or is positioned over, the center of the central portion of the speaker diaphragm.

In accordance with another embodiment of this aspect of the invention, the stabilizing member further comprises an interior axially-located and star-shaped support member comprising proximal and distal ends, integral support ribs and a base. The interior axially-located support member is attached at the interior axially-located support member's distal end to the base, and the base depends from the yoke. The proximal end of the interior axially-located support member engages the interior surface of the central diaphragm portion at the center of the central diaphragm where the proximal end of the stabilizing member is attached to the central diaphragm.

Preferably, the proximal end of the stabilizing member of the loudspeaker of the first embodiment of this aspect of the invention further comprises an upper attachment surface that is comprised of a partially torus-shaped upper surface integral with a hyperbolic-shaped lower inner surface wherein the lower portions of the hyperbola approach a point or a small circle. The upper surface of the stabilizing member is fixed to the interior surface of the central diaphragm portion adjacent the center of the central diaphragm where the proximal end of the stabilizing member is attached to the central diaphragm to form a dimple in the central diaphragm.

In an alternative embodiment of this aspect of the invention, the stabilizing member is star-shaped in cross-section comprising a plurality of fins and a base member, wherein the fins terminate in a proximal end of the stabilizing member to form a plurality of upper surfaces that together comprise a plurality of upper surfaces forming a partial torus shape and that are integral with a corresponding plurality of hyperbolic-shaped lower inner surfaces wherein the lower portions of the hyperbola approach a central point, or a small central circle. The upper surfaces are fixed to the interior surface of the central diaphragm portion adjacent the center of the central diaphragm where the proximal end of the stabilizing member is attached to the central diaphragm to form a dimple in the central diaphragm.

These embodiments of the invention illustrate yet other ways of providing for a stabilizing member that is attached to the inner (underside) surface and center of the diaphragm of the loudspeaker in a plane that is different from the outer attachment plane of the periphery of the ring radiator portion of the diaphragm so as to help prevent rocking of the speaker. The bridge member not only protects the diaphragm from being bumped, as with a vacuum cleaner, book or other device, but it also lends to the aesthetics of the loud speaker.

Those skilled in the art of speaker design will appreciate that there are several ways in accordance with the invention for attaching the central axis of the radially-extending stabilizer member, such as a central diaphragm portion, to an axially-located stabilizing member. For example, a T-shaped broadened head portion attached to, or integral with, a narrowed neck post that may be preferably inserted into an interior (or exterior as the case may be) axially-located stabilizer member, the composite stabilizing member and T-shaped broadened head becoming an interior exterior stabilizing member with the neck thereof passing through the opening in the diaphragm and the adjacent proximal portions of the T-shaped broadened head and axially-located stabilizer member engaging opposing surfaces of the diaphragm or radially-extending support member. Glue may be applied at the described location of engagement to one or both of the surfaces of the diaphragm/radially-extending support member, or the stabilizer members could be positioned so as to pinch the diaphragm at the attachment location, which together with the neck portion of the stabilizer passing through the opening in the diaphragm/radially extending support member serves to prevent translation of the same. Likewise, it will be appreciated that there need not be a stabilizing structure adjacent both the inner and outer surfaces of the dome diaphragm, but rather the dome diaphragm may simply be glued to a single adjacent support structure or stabilizing member, whether the support structure be adjacent the interior or the exterior surface of the inner dome diaphragm or corresponding radially extending support member.

It will also be appreciated by those of ordinary skill in the art that the axially-located stabilizer member may be mostly exterior of the diaphragm, interior of the diaphragm, or entirely interior or exterior of the diaphragm depending on the embodiment of the invention employed. Further, it will be appreciated that different combinations face plates, bridges and stabilizing members, as set forth independently, or combined, herein may be employed without departing from the true scope and spirit of the invention.

It will be appreciated by those of ordinary skill in the art to which the invention pertains that there are many ways to attach the diaphragm to the stabilizing member. For example, depending upon the type of materials used, it may be glued, welded or otherwise bonded to one or more stabilizing members. Alternatively, the diaphragm may be pinched between two adjacent stabilizing members' members. Also, it will be appreciated that a combination of one or more of these methods of attachment, together with a portion of a stabilizing member passing through an opening in a diaphragm or support structure, may be employed, together with any one of the bridge structures disclosed herein, without departing from the true scope and spirit of the invention as claimed.

The subject matter of the present invention is particularly pointed out and distinctly claimed in the concluding portion of this specification. However, both the organization and method of operation, together with further advantages and objects thereof, may best be understood by reference to the following descriptions taken in connection with accompanying drawings wherein like reference characters refer to like elements.

DETAILED DESCRIPTION

Figure 3A:
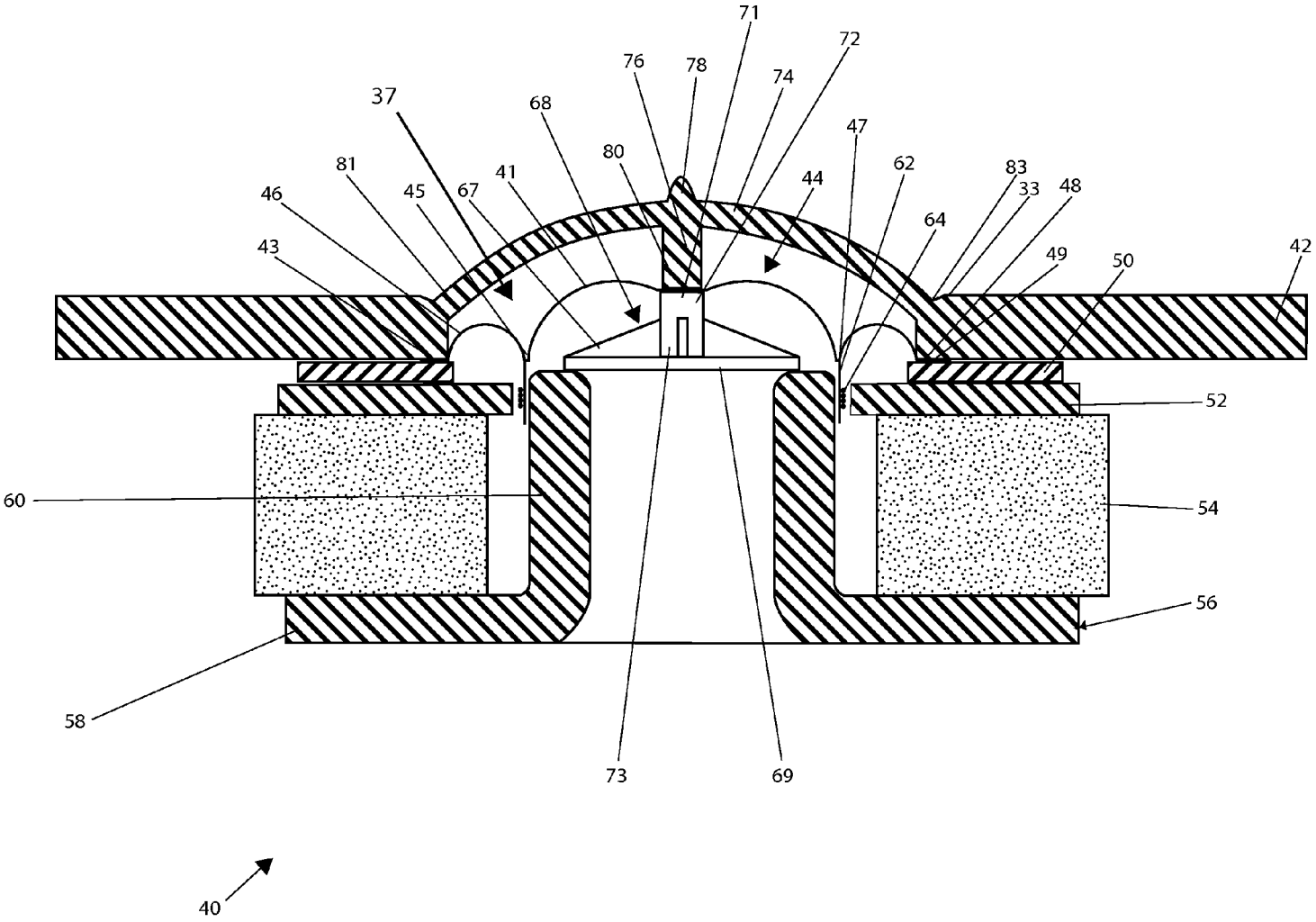
FIG. 3*a* is a front cross-section view of a speaker system in accordance with an embodiment of the invention.
Figure 5:
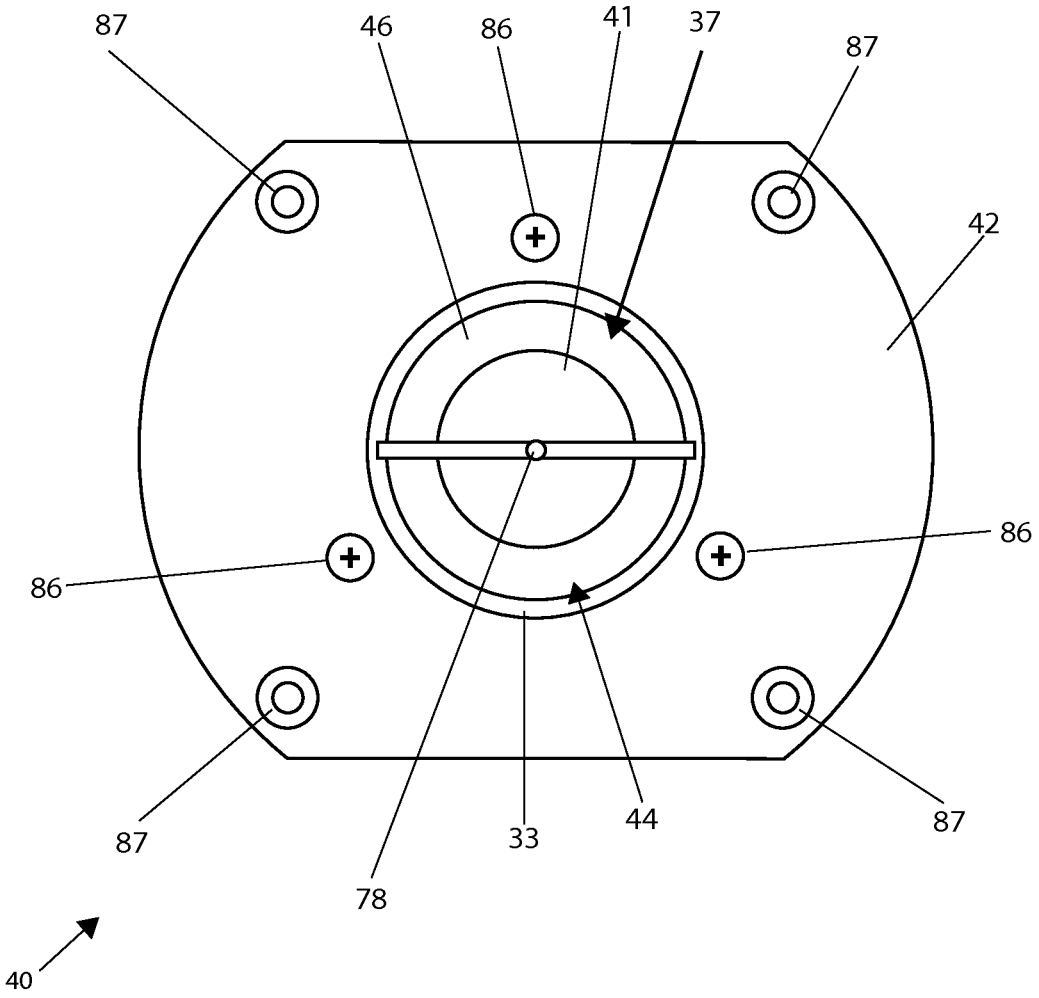
FIG. 5 is a top plan view of the speaker system shown in FIG. 3*a* and in accordance with a first embodiment of the invention.

Referring to FIGS. 3*a* and 5, a loudspeaker system 40 in accordance with an embodiment of the invention is shown comprising a face plate 42 having a chamfered inner diameter region 33 defining a preferably circular opening 37 for a speaker diaphragm 44. The speaker diaphragm 44 is preferably comprised of an outer-ring radiator portion 46, preferably made of silk or other fabric that is in the shape of an arched strip, in profile. The outer-ring radiator portion 46 has a skirt portion 48 for attaching the outer-ring radiator diaphragm portion, as by gluing, to an upper surface of a diaphragm chassis 50.

As with the prior art, there are attachment locations 43, 45, 47, 49 of diaphragm 44 which lie in a first plane along with the voice coil armature 62. Attachment location 45, 47 includes attachment of outer-ring diaphragm portion 46 being attached, as with gluing for example, near the inner circumference of the outer-ring portion diaphragm portion 46 and near the outer circumference of inner, or central, diaphragm portion 41 by means of a cylindrical, voice coil annular armature 62 upon which is wound the voice coil windings 64 which are free to vibrate between a top plate 52 and yoke 56 of speaker 40.

The diaphragm chassis 50 is shown sandwiched between the face plate 42 and an annular top plate 52, and the annular top plate is adjacent and in contact with annular magnet 54. An annular L-shaped (for half of a cross section view) yoke 56 forms a base 56 for attachment with the magnet 54 and a perpendicular cylindrical member 60 which, together with top plate 52 forms an annular air gap within which gap armature 62 with voice coil winding 64 thereon is free to move relative to the top plate and yoke in response to electronic stimulus representing sound and against the magnetic field, or magnetic flux, created by the magnet 54 through the top plate and the yoke. Preferably the voice coil 64 and armature 62 move linearly, responsive to the electronic stimulus, along a line that is parallel to the axis of the speaker.

An interior axially-aligned internal stabilizer member 72 preferably extends integrally from the center of a star-shaped support 68 having a vented or unvented integral base 69 and integral support ribs 67 extending between the internal stabilizer member 72 and integral base 69. Base 69 of star-shaped support 68 rests upon cylindrical yoke member 60. Internal stabilizer member 72 has a proximal portion, or end, 71 and a distal portion, or end, 73. Proximal end 71 of internal stabilizer 72 abuts, and is preferably attached with glue to an interior surface 51 (shown in FIGS. 4*a* and *b*) of a centrally-recessed area of central diaphragm portion 41 of diaphragm 44. Distal end 73 of internal stabilizer member 72 is preferably integral with base 69 of star-shaped support 68.

An arched bridge member 74 extends from face plate 42, spanning the diameter of the circular opening defined by the face plate, with a first end 81 of the bridge being attached at a location on the internal circumference of the face plate and a second end 83 of the bridge being attached preferably at a diametrically opposed location on the internal circumference of the face plate. Midway on the span of bridge member 74 there is attached a narrow rod, exterior axially-located stabilizer member 76, having a distal portion 78 and a proximal portion 80 positioned forward of the central dome portion 41 of the diaphragm 44 and depending adjacent the distal portion from the bridge member. The exterior axially-located stabilizer 76 is attached at its proximal portion 80 to an exterior surface 53 (shown in FIG. 4) of a central recessed area of the central diaphragm portion 41 opposite and adjacent the attachment point described above between proximal portion or end 71 of interior axially-located stabilizer member 72 and interior surface 43 of the central recessed area of the central diaphragm portion 41. This sandwich-style attachment of the central recessed area of central diaphragm portion 41 of diaphragm 44 between the internal axially-located stabilizer member 72 and the exterior axially-located stabilizer member 76 is located in a second plane that is a significant axial distance from the first plane of attachment points 43, 45, 47, 49 described above and serves to support and stabilize the diaphragm along every possible axis of motion. Importantly, this second plane of stabilization prevents the central recessed area of the central diaphragm portion 41 of diaphragm 44 from translating off the axial intersection point of the central diaphragm portion 41 and the stabilizer members 76, 72 to which it is glued as would be the case in a rocked condition of the diaphragm. The present invention applies to speakers that are both vented and not vented alike.

Figure 4A:
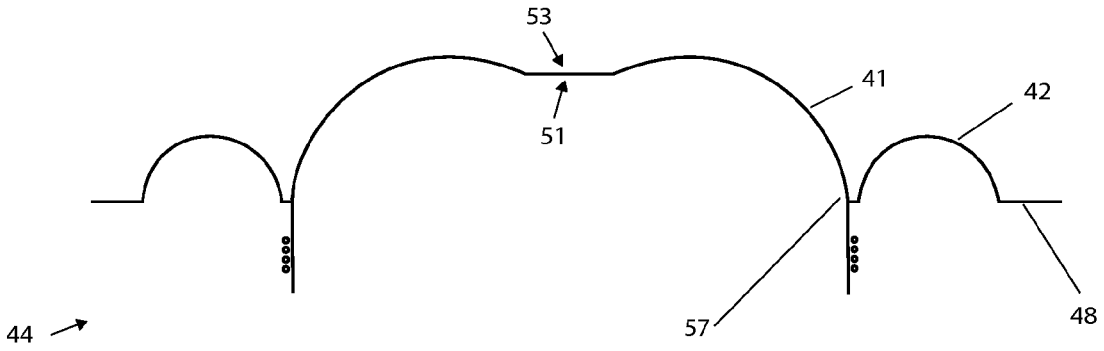
FIG. 4*a* is a cross-section view of a diaphragm in accordance with an embodiment of the invention shown in FIG. 3*a;*
Figure 4B:
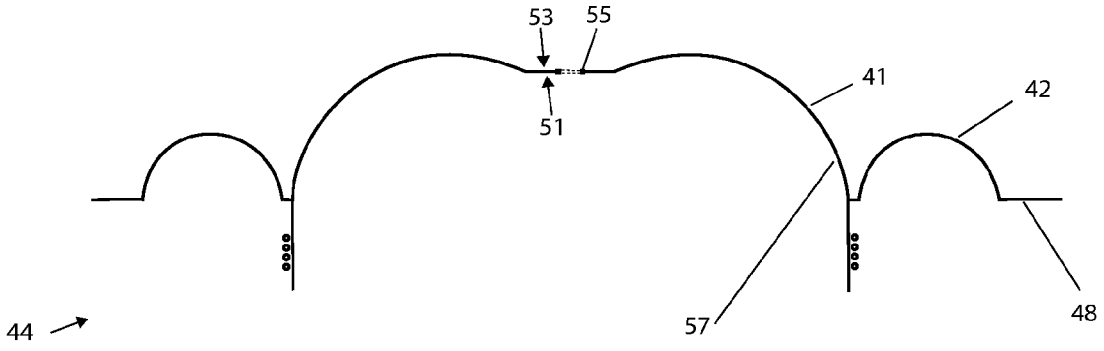
FIG. 4*b* is a cross-section view of a diaphragm in accordance with another embodiment of the invention shown in FIGS. 3*b*, 3*d* and 3*e*.

Looking specifically at FIGS. 4*a* and 4*b*, it can be seen that the central diaphragm portion 41 comprises a modified dome, wherein the central diaphragm portion defines a centrally recessed area at 51, 53 which gives the central diaphragm portion a dimpled appearance.

As seen in FIG. 5, screws 86 are used to secure the face plate 42 to the diaphragm chassis 50 (shown in FIG. 3*a*), top plate 52, magnet 54 and yoke member 56. Also as shown in FIG. 5, there are mounting holes 87 for receiving a screw for purposes of mounting the speaker in a cabinet.

Figure 3B:
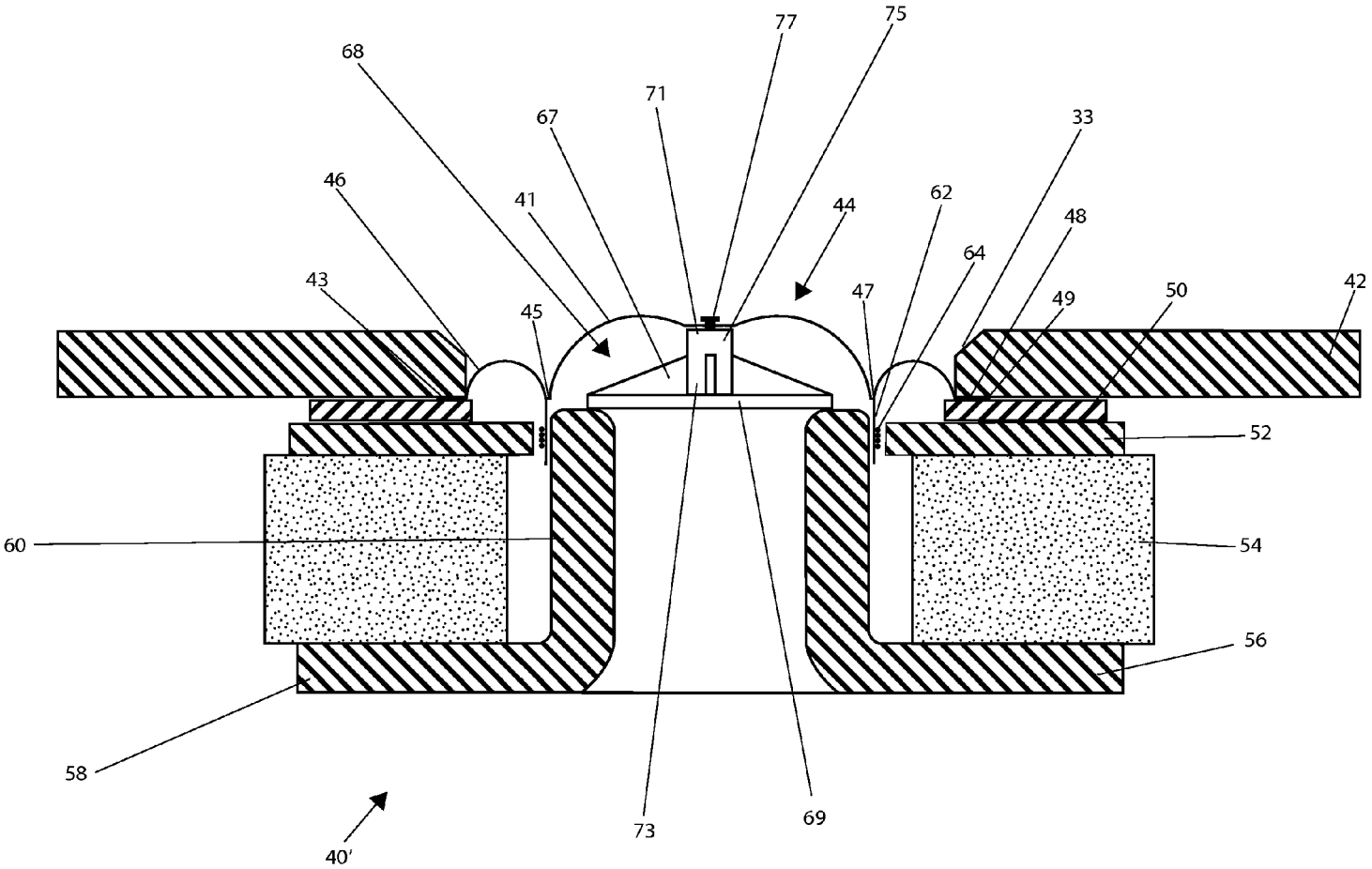
FIG. 3*b* is a front cross-section view of a speaker system in accordance with an alternate embodiment of the invention.

Referring now to FIG. 3*b*, an alternate embodiment of the invention is shown comprising face plate 42', diaphragm chassis 50, top plate 52, annular magnet 54 and yoke 58. This embodiment of the invention also preferably employs a star-shaped support 68 having integral support ribs 67 and base 69 resting upon cylindrical member 60 of yoke 58 for supporting an interior exterior axially-located stabilizer member 75 having a distal portion or end 73 attached to base portion 69 of star-shaped support member 68 and a proximal portion or end 71 extending to a second plane that is sufficiently distant, preferably forwardly for this embodiment, from the first plane in which attachment points 43, 45, 47, 49 of the diaphragm lie in attachment to the voice coil armature 62 and diaphragm chassis 50.

Figure 3C:
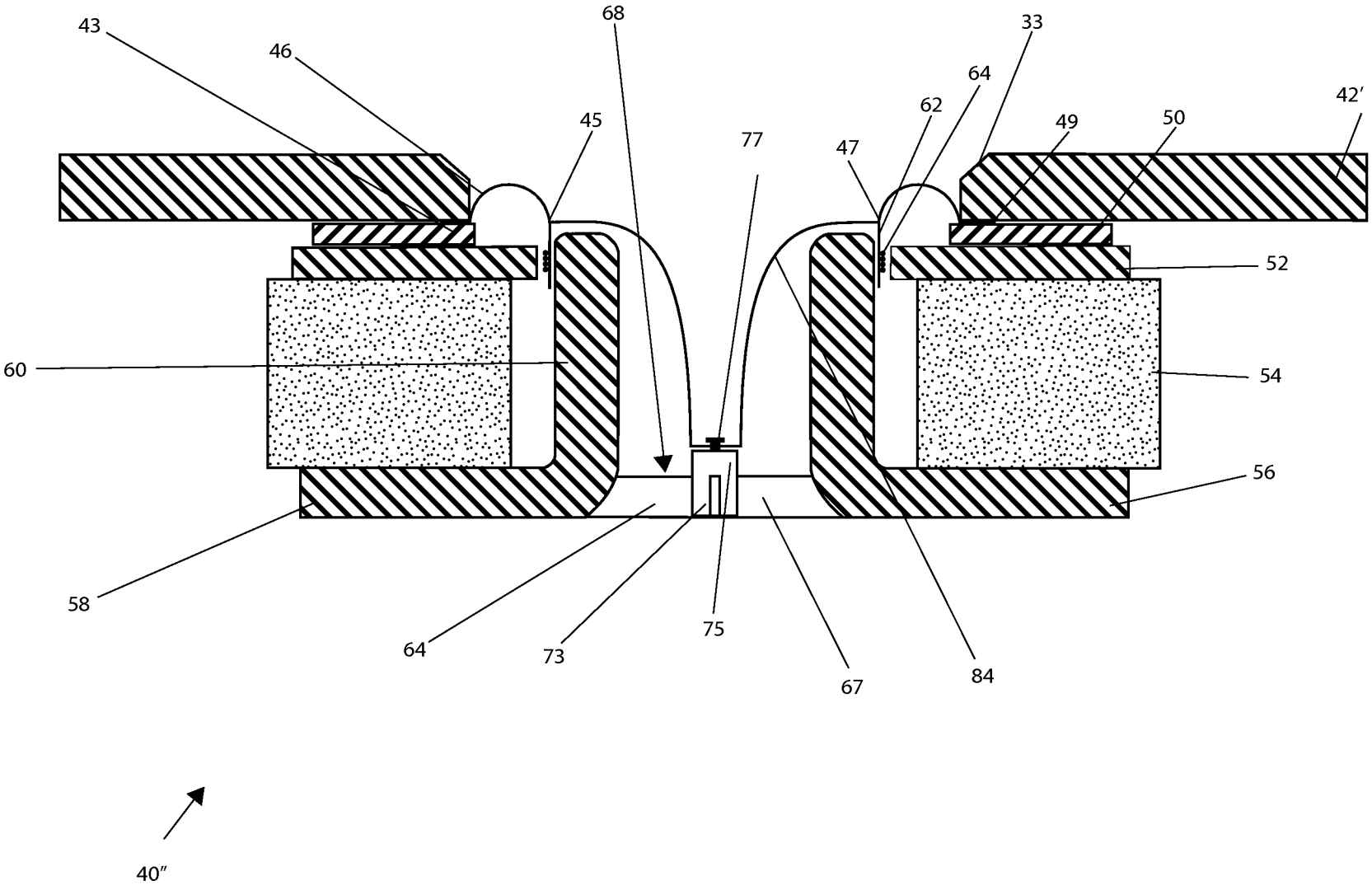
FIG. 3*c* is a front cross-section view of a speaker system in accordance with an alternate embodiment of the invention.
Figure 3D:
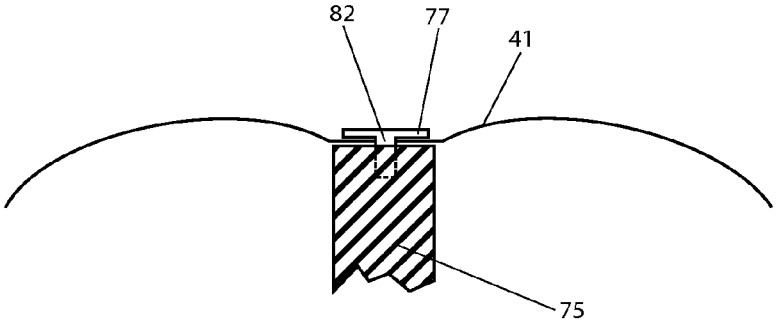
FIG. 3*d* is a detailed front cross-section view of attachment means in accordance with multiple embodiments of the invention.

As shown in a close-up view FIG. 3*d*, there is a broadened T-shaped head exterior stabilizer support portion or member 77 integral with a narrowed neck portion 82 which is preferably inserted into an opening in proximal portion 71 of interior exterior axially-located stabilizer member 75. The narrowed neck portion 82 of broadened head T-shaped support portion 77 is of a cross-section diameter large enough to be retained, as with a force fit, or snap-in means, within the opening in proximal portion 71. Alternatively, T-shaped support portion 77 may be screwed into proximal portion 71, the shaft of the screw being represented by narrowed neck portion 82.

As shown in FIG. 4*b*, the central diaphragm portion 41 has a central hole therein through which narrowed neck portion 82 of broadened head T-shaped support portion 77 passes through. The cross section diameter of narrowed neck portion 82 is the same as the diameter of an opening or collar 55 in central diaphragm portion 41, providing for preventing or holding the diaphragm from lateral translation relative to the axis of the loudspeaker. Since the central diaphragm portion 41 is seen in cross section in FIGS. 4*a* and 4*b*, it will be appreciated that in a plan view, the central diaphragm portion 41 may be seen or described as a radially-extending stabilizer member. In addition to the fixation of the diaphragm 44 through attachment of central diaphragm portion 41, the central diaphragm is, in at least one embodiment of the invention, sandwiched and held in place along the axis of the loudspeaker at the centrally recessed area 51, 53 of central diaphragm portion 41. Glue is advantageously placed at the location of intersection of narrowed neck portion 82 and central diaphragm portion 41 to fix the central diaphragm portion to the proximal portion 71 of stabilizer 75, narrowed neck portion 82 and the proximal portion (or inner surface) of broadened head T-shaped support portion 77 and thereby prevent rocking or translation of the center of the diaphragm off of its axis to create distortion of speaker sound. Alternatively, in the case of use of a stabilizer framework 84, a weld or other means of attachment may be employed to attach the central portion of the stabilizer framework, such as a collar 55, to the narrowed neck portion 82, broadened head 77 and or proximal portion 71 of the stabilizer member 75. Still further, in the event the stabilizer framework is not flexible, collar 55 may be allowed to slide along, or ride, narrowed neck portion 82 via use of bearing or ferro-fluid support means.

The area of intersection and sandwich construction and attachment of central diaphragm portion 41 at narrowed neck portion 82 is in a second plane that is an axially sufficient distance from the first plane of attachments 43, 45, 47, 49 described above to provide leverage sufficient to stabilize the diaphragm against rocking as further described below in connection with FIGS. 6*a-d*.

Referring now to FIG. 3*c*, yet another embodiment of the invention is shown comprising face plate 42, diaphragm chassis 50, top plate 52, annular magnet 54 and yoke 58. In this third embodiment of the invention, it will be appreciated that outer-ring diaphragm portion 46 is attached along its outer periphery, as with the other embodiments of the invention, to diaphragm chassis 50 as shown with attachments 43, 49, and are attached along its inner periphery to annular voice coil armature 62 adjacent voice coil 64. As with previous embodiments of the invention described above, these attachments are made in a first plane. Annular voice coil armature 62 interconnects outer-ring diaphragm portion 46 and inner diaphragm portion, stabilizer framework, radially extending support 84. This third embodiment of the invention preferably comprises an interior exterior axially-aligned stabilizer 75, which extends from a star-shaped support member 68 with integral base 69 that is fixed to yoke 56 or alternatively to a base plate. Interior exterior axially-aligned stabilizer 75 extends from its distal end 73 from the base 69 of star-shaped support 68 to a proximal portion or end 71 in a second plane that is sufficiently rearwardly distant, or aft, from the first plane of attachment points 43, 45, 47, 49 of the inner diaphragm portion, stabilizer framework, radially-extending stabilizing member 84 described above to stabilize the diaphragm 46, 84 against rocking.

The star-shaped support member 68 with interior exterior stabilizer member 75 is functionally the same in this embodiment as that used with the previous embodiment of the invention. Thus, as described above and shown in close-up view FIG. 3*d*, there is a broadened T-shaped head exterior stabilizer support portion or member 77 integral with a narrowed neck portion 82 which is preferably inserted into an opening in proximal portion 71 of interior exterior axially-located stabilizer member 75. The narrowed neck portion 82 of broadened head T-shaped support portion 77 is of a cross-section diameter large enough to be retained, as with a force fit, or snap-in means, within the opening in proximal portion 71. Alternatively, T-shaped support portion 77 may be screwed into proximal portion 71, the shaft of the screw being represented by narrowed neck portion 82.

Again, as shown in FIG. 4*b*, the central diaphragm portion 41 has a central hole therein through which narrowed neck portion 82 of broadened head T-shaped support portion 77 passes through. The cross section diameter of narrowed neck portion 82 is the same as the diameter of an opening or collar 55 in central diaphragm portion 41, providing for preventing or holding the diaphragm from lateral translation relative to the axis of the loudspeaker. Since the central diaphragm portion 41 is seen in cross section in FIGS. 4*a* and 4*b*, it will be appreciated that in a plan view, the central diaphragm portion 41 may be seen or described as a radially-extending stabilizer member. In addition to the fixation of the diaphragm 44 through attachment of central diaphragm portion 41, the central diaphragm is, in at least one embodiment of the invention, sandwiched and held in place along the axis of the loudspeaker at the centrally recessed area 51, 53 of central diaphragm portion 41. Glue is advantageously placed at the location of intersection of narrowed neck portion 82 and central diaphragm portion 41 to fix the central diaphragm portion to the proximal portion 71 of stabilizer 75, narrowed neck portion 82 and the proximal portion (or inner surface) of broadened head T-shaped support portion 77 and thereby prevent rocking or translation of the center of the diaphragm off of its axis to create distortion of speaker sound. Alternatively, in the case of use of a stabilizer framework 84, a weld or other means of attachment may be employed to attach the central portion of the stabilizer framework to the narrowed neck portion 82, broadened head 77 and or proximal portion 71 of the stabilizer member 75. Still further, in the event the stabilizer framework is not flexible, collar 55 may be allowed to slide along, or ride, narrowed neck portion 82 via use of bearing or ferro-fluid support means.

The area of intersection and sandwich construction and attachment at narrowed neck portion 82 is in a plane that is an axially sufficient distance rearwardly from the first plane of attachments 43, 45, 47, 49 to provide leverage sufficient to stabilize the diaphragm 46, 84 against rocking.

Figure 3E:
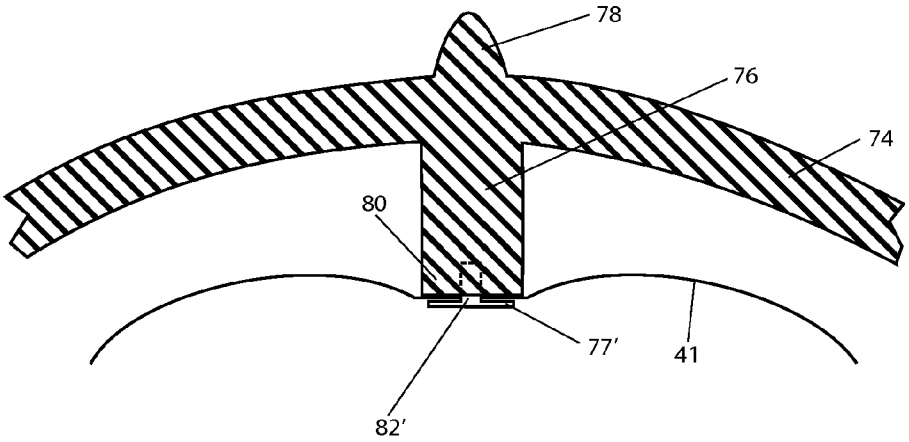
FIG. 3*e* is a detailed front cross-section view of a speaker stabilization means in accordance with an alternate embodiment of the invention.

In accordance with still another alternate embodiment of the invention with stabilization means of the invention shown in FIG. 3*e*, there is provided an improved loudspeaker of the type described above in connection with other embodiments of the invention, further comprising a central diaphragm portion 41 defining a central axial opening 55 (shown in FIG. 4*b*) therein and located in a second plane through which narrowed neck 82' passes and which is parallel to the first plane in which outer diaphragm portion 46 is attached to the diaphragm chassis 50 and voice coil armature 62. The central diaphragm portion 41 comprises an interior surface 51, an exterior surface 53 and an outer periphery 57. The central diaphragm portion 41 is attached along the outer periphery 57 of the central diaphragm portion to one of the voice coil armature 62 and the inner periphery of the outer annular arch-profiled strip diaphragm portion 46 in a first plane.

A bridge or other support member 74 depending from the face plate 42 spans or partially spans the circular opening in which the central diaphragm portion 41 and the outer diaphragm portion 46 resides. An exterior axially-located stabilizer member 76 comprises a distal portion 78 and a proximal portion 80 positioned forward of the central diaphragm portion 41 and is attached depending adjacent the distal portion of the exterior axially-located stabilizer member from the support member 74.

An axially-located, upside-down, T-shaped attachment member comprising a narrowed neck 82' and an interior broadened head 77' holds diaphragm portion 41 in a stabilized position similarly as described in connection with FIGS. 3*b*, 3*c* and 3*d*, except with this embodiment of the invention, the interior broadened head 77' is, as its name suggests, located on the interior of the diaphragm portion 41. Further, narrowed neck 82' of interior broadened head 77' is inserted or screwed through an opening or hole 55 of diaphragm portion 41 into proximal portion 80 of exterior axially-located stabilizer member 76 such that the diaphragm portion 41 is supported and stabilized entirely through the bridge member 74. This is unlike other embodiments of the invention where support and stabilization is also derived from the yoke member 60 or alternatively a base plate through a star-shaped member 68 and internal axially-located stabilizer member 75.

In this embodiment of the invention, as with other embodiments of the invention, the narrowed neck 82' is of sufficiently small cross-section diameter to reside within the axial opening in the central diaphragm portion 41 in the second plane, and the interior broadened head 77' has a proximal portion thereon adjacent the central diaphragm portion 41 defining the opening 55.

Thus, preferably by gluing, the exterior surface 53 and the interior surface 51 of the central diaphragm portion 41 is attached to at least one of the proximal portion of the interior broadened head 77' and the proximal portion 80 of the exterior axially-located stabilizer member 76 in the second plane that is of sufficient distance from the first plane to provide leverage sufficient to stabilize the diaphragm 44 against rocking.

Alternately, with this embodiment of the invention, or with any other embodiment of the invention, the diaphragm or radially-extending support member 41 may be held in place by being pinched or sandwiched in place by the stabilizer members 76, 77'. In such case, gluing may not be necessary to hold the diaphragm/support member in place. Thus, while it is preferred that the central diaphragm/radially-extending support member 41 be attached, usually by gluing, bonding or welding, depending upon the materials used, and at an axially distant location from the first plane of attachment of the diaphragm 44, on both an interior and an exterior surface of the central diaphragm/radially-extending support member 41, it will be appreciated by those of ordinary skill in the art to which the invention pertains that the diaphragm may be pinched between two adjacent members, or one surface of the diaphragm may be glued to a stabilizer member while the other surface is engaged in a non-slip fit with the adjacent stabilizer member.

It will be appreciated by those of ordinary skill in the art that with this alternate embodiment of the invention, and with each other embodiment of the invention, the second plane location of attachment at the central axis of the diaphragm with the proximal portion of the stabilizer member or members, whether exterior or interior of the diaphragm, or both, may be fore or aft of the first plane voice coil armature—diaphragm attachment without departing from the scope of the invention as set forth in the claims. In other words, stabilization of the central diaphragm portion of the loudspeaker may be accomplished by fixing the diaphragm on its axis, either a distance forward of the voice coil or a distance rearward of the voice coil.

Figure 3F:
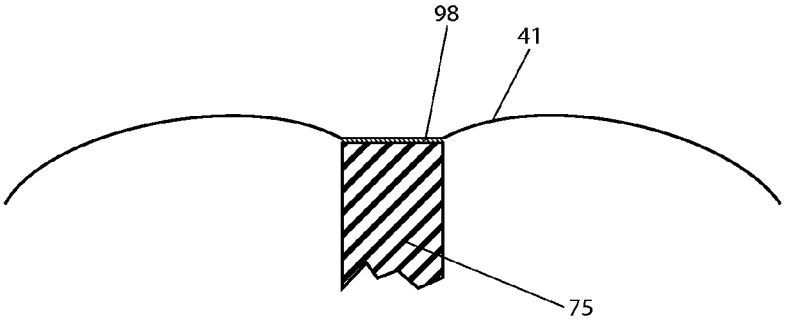
FIG. 3*f* is a detailed front cross-section view of a speaker stabilization means in accordance with an alternate embodiment of the invention.
Figure 3G:
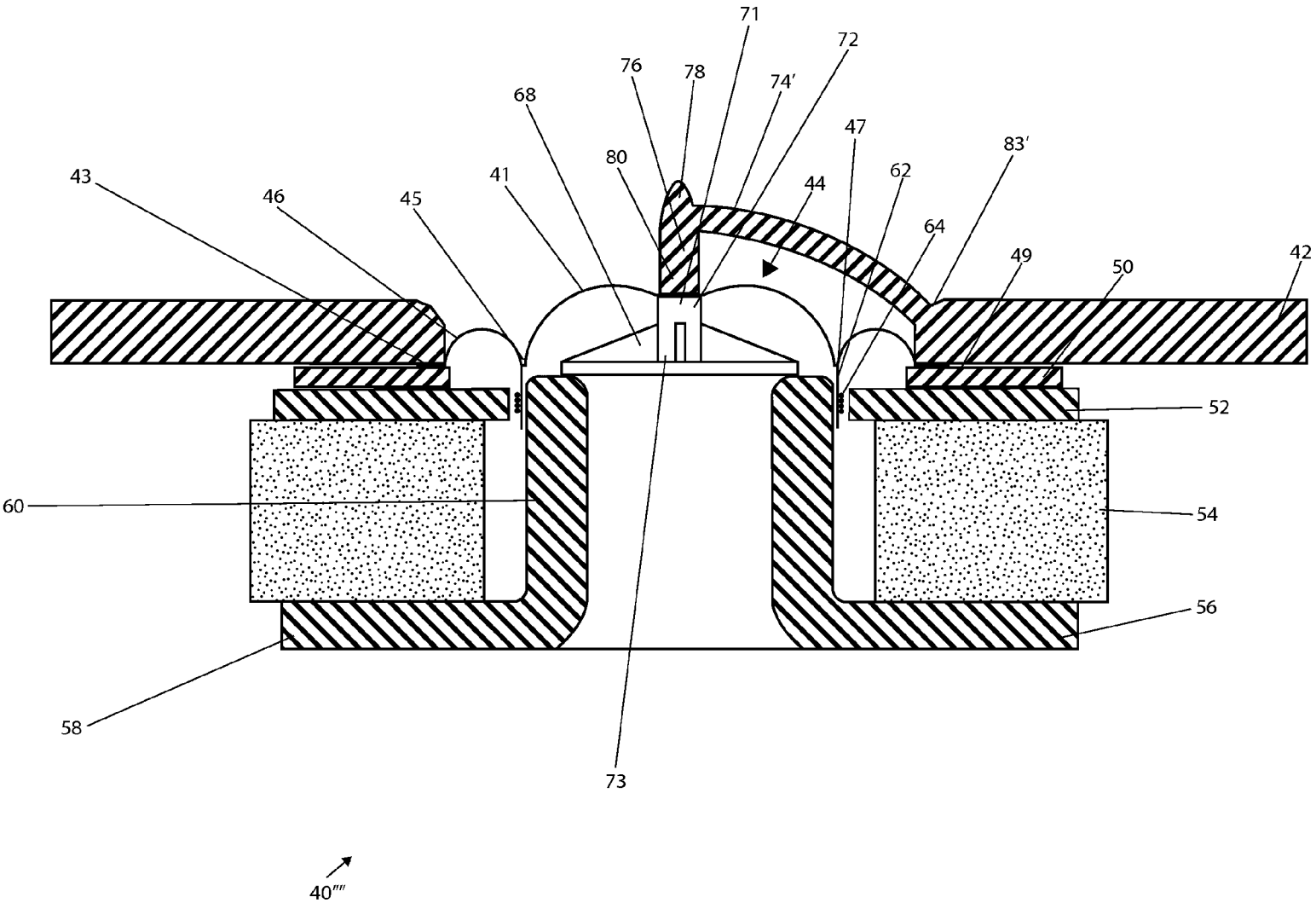
FIG. 3*g* is a front cross-section view of an alternate embodiment of a speaker system in accordance with the invention and showing a cantilevered support member.

Further, it will be appreciated that, as with the first embodiment of the invention described above, the support member may comprise either a bridge 74 or a cantilever beam 74' as shown in FIG. 3*g*.

As shown in connection with FIG. 3*f*, diaphragm portion 41 may be glued as shown at 98 to the proximal portion of an internally axially-located stabilizing member 75. In such case, there would be no need for a T-shaped head 77, 82 like that shown in FIG. 3*d*. Alternatively, and similarly to FIGS. 3*e* and 3*f*, it will be appreciated by those of ordinary skill in the art that the diaphragm portion 41 may be glued to the proximal portion of an externally axially-located stabilizing member 76 depending from a bridge member 74 similar to that shown in FIG. 3*e*, but without a T-shaped head 82', 77' as shown in FIG. 3*f*.

Referring to FIGS. 9*a*-9*g*, a loudspeaker system 940 in accordance with an alternative embodiment of the invention is shown comprising a face plate 42' having a chamfered inner diameter region 33' defining a preferably circular opening 37' for a speaker diaphragm 44' similar to that shown in either FIG. 4*a* or 4*b*. The speaker diaphragm 44' is preferably comprised of an outer-ring radiator portion 46', preferably made of silk or other fabric that is in the shape of an arched strip, in profile. The outer-ring radiator portion 46' has a skirt portion 48' for attaching the outer-ring radiator diaphragm portion, as by gluing, to an upper surface of a diaphragm chassis 50'.

As with the prior art, there are attachment locations 43', 45', 47', 49' of diaphragm 44' which lie in a first plane along with the voice coil armature 62'. Attachment location 45', 47' includes attachment of outer-ring diaphragm portion 46' being attached, as with gluing for example, near the inner circumference of the outer-ring portion diaphragm portion 46' and near the outer circumference of inner, or central, diaphragm portion 41' by means of a cylindrical, voice coil annular armature 62' upon which is wound the voice coil windings 64' which are free to vibrate between a top plate 52' and yoke 60' of speaker 940.

The diaphragm chassis 50' is shown sandwiched between the face plate 42' and an annular top plate 52', and the annular top plate is adjacent and in contact with annular magnet 54'. The yoke 60' extends from a base 56' for attachment with the magnet 54' which, together with top plate 52' forms an annular air gap within which gap armature 62' with voice coil winding 64' thereon is free to move relative to the top plate and yoke in response to electronic stimulus representing sound and against the magnetic field, or magnetic flux, created by the magnet 54' through the top plate and the yoke. Preferably the voice coil 64' and armature 62' move linearly, responsive to the electronic stimulus, along a line that is parallel to the axis of the speaker. Screw holes 86' and 87' are provided through the various portions of the speaker 940 enabling interconnecting of the speaker portions as is understood by those of ordinary skill in the art of speaker manufacture. Furthermore the general construction of the base 56', yoke 60', magnet 54', top plate 52' and diaphragm chassis 50 so as to allow proper ventilation and functioning of the speaker 940 are generally understood by those of ordinary skill in the art.

The speaker 940 of this embodiment of the invention further comprises a bridge member 900 comprising a plurality (preferably two or three) of forwardly arched extension members 902, 903 interconnected at a central intersection location 901 forward of the central portion 41' of the speaker diaphragm 44', each extension member depending from an attachment location 904 on the preferably chamfered face plate periphery 33' defining the opening 37'. The bridge member 900 at least partially spans the opening 37' defined by the face plate 42' for the speaker diaphragm 44'. In this context, "partially spans" means that while a portion of the bridge member spans portions of the opening that are not directly lying over a bisecting line, at least a portion of the bridge is positioned over the center of the central diaphragm.

The loudspeaker 940 further comprises a centrally located member 906 having a forward pointed end 907 and an aft base portion 909, the centrally located member being attached to the bridge member 900 at the central intersection location 901 of the extension members 902, 903 and adjacent the aft or rearward base portion of the centrally located member. The loudspeaker 940 further comprises an interior axially-located stabilizing member 968 comprising a proximal end 971 and a distal end 73', the distal end of the stabilizing member being attached to the yoke 60', and the proximal end engaging the interior surface 910 of the central diaphragm portion 41' at the center of the central diaphragm where the proximal end of the stabilizing member is attached to the central diaphragm in a second plane parallel to the first plane and that is of sufficient distance from the first plane to provide out-of-axis movement resistance sufficient to stabilize the diaphragm against rocking.

Preferably, the opening 37' defined by the inner periphery 33' of the face plate 42' of the speaker 940 of this embodiment of the invention is circular and the bridge member 900 comprises two y-shaped extension members 902, 903, each y-shaped extension member comprising two outer legs 903 terminating with attachment ends 904 and an inner leg 902 having an attachment area 901. Each y-shaped extension member 902, 903 depends at the outer attachment ends 904 from attachment locations 904 on the inner periphery 33' of the face plate 42' defining the opening 37' for the speaker diaphragm 44', and each y-shaped extension member 902, 903 is interconnected to the other y-shaped extension member (preferably the two y-shaped members are a single integral bridge unit made of rigid plastic or other durable rigid substance) at the inner attachment area 901 of each extension member. The inner legs 902 of the y-shaped extension members 902, 903 form a portion of the bridge that is linear and passes over, or is positioned over, the center of the central portion 41' of the speaker diaphragm 44'.

Figure 9A:
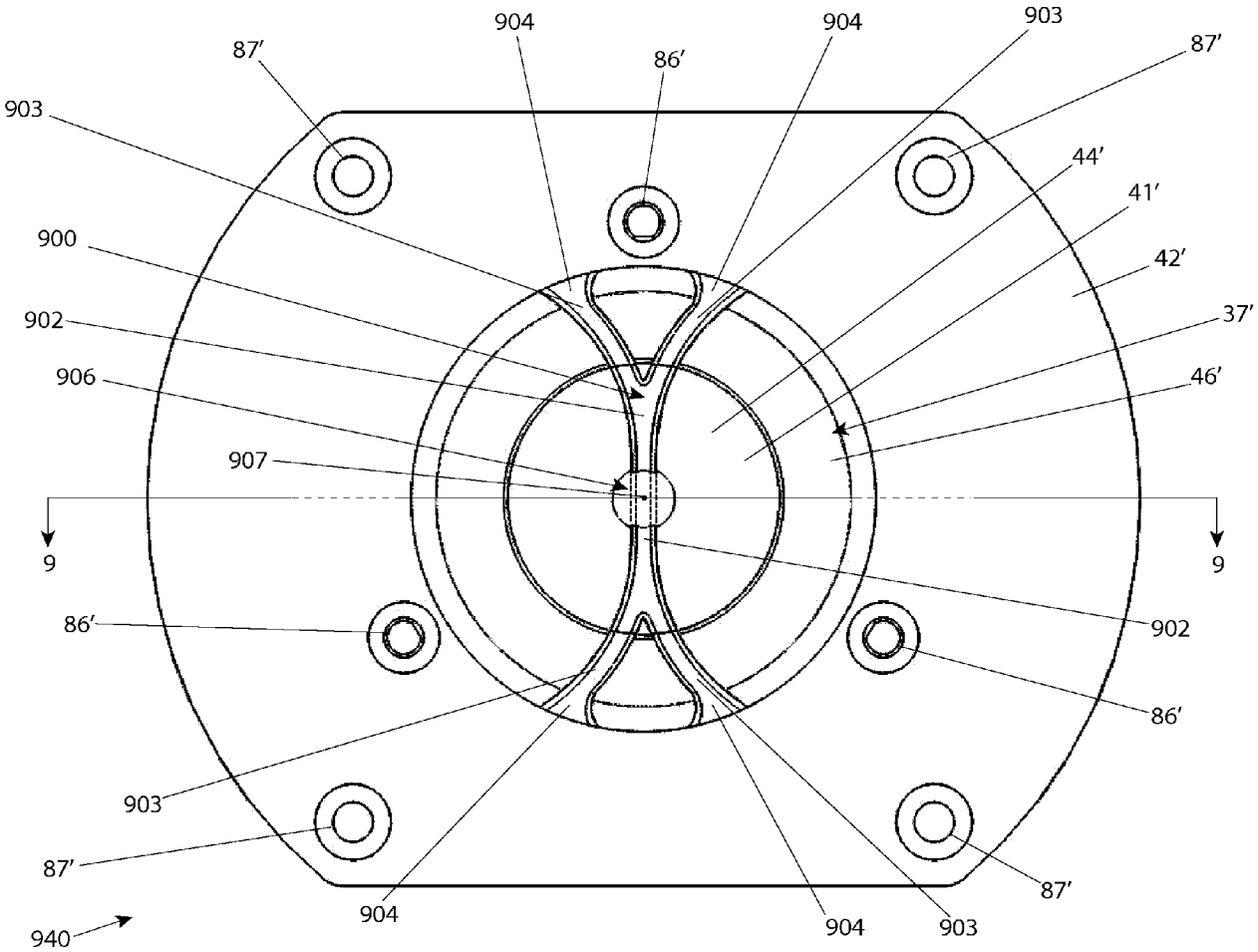
FIG. 9*a* is a top plan view of an alternate embodiment of the invention and showing section line 9-9 for illustrating the location for the sections taken in FIGS. 9*b, c, e* and *f;*
Figure 9B:
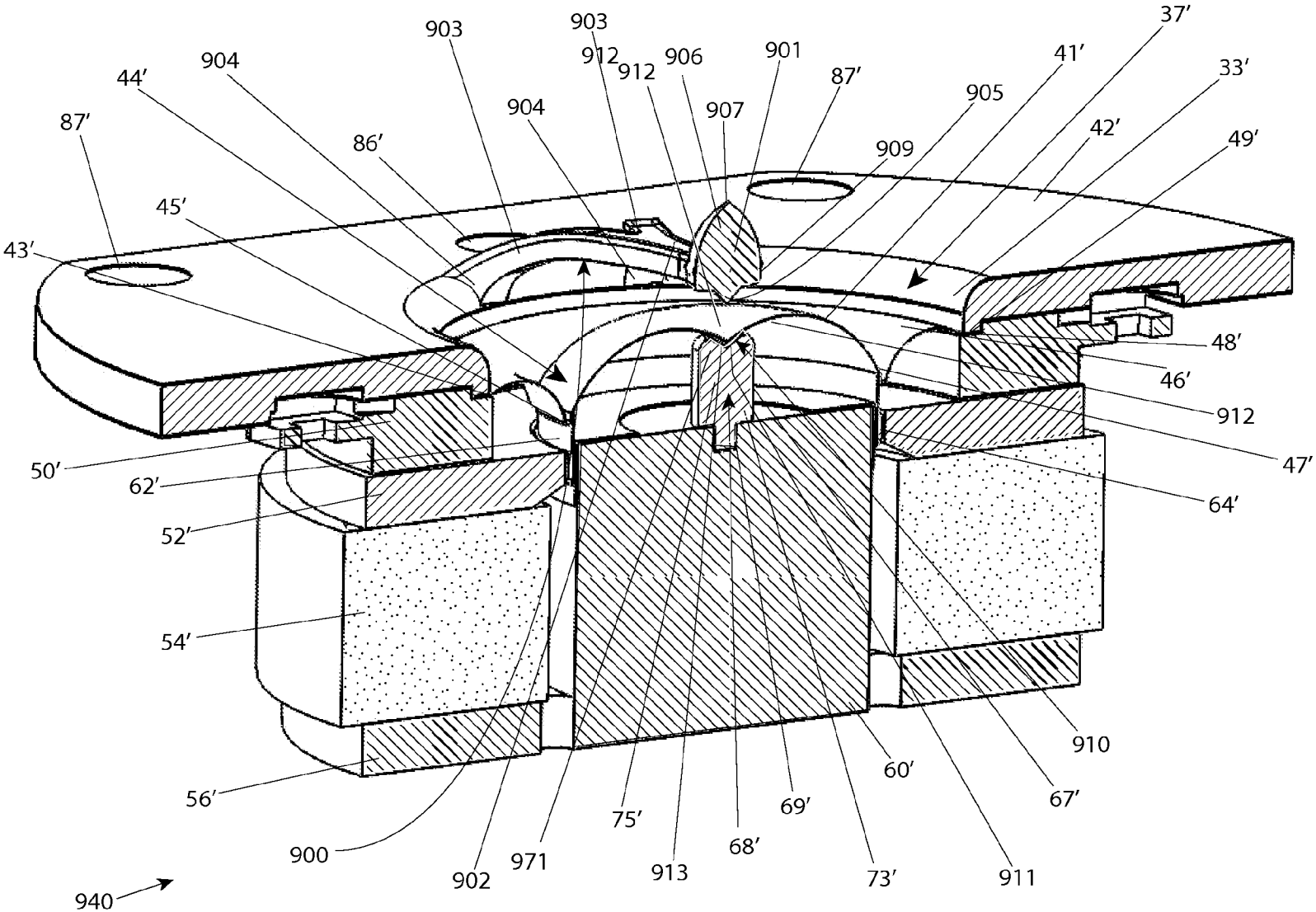
FIG. 9*b* is a cross-section perspective view of the alternate embodiment of the invention of FIG. 9*a;*
Figure 9C:
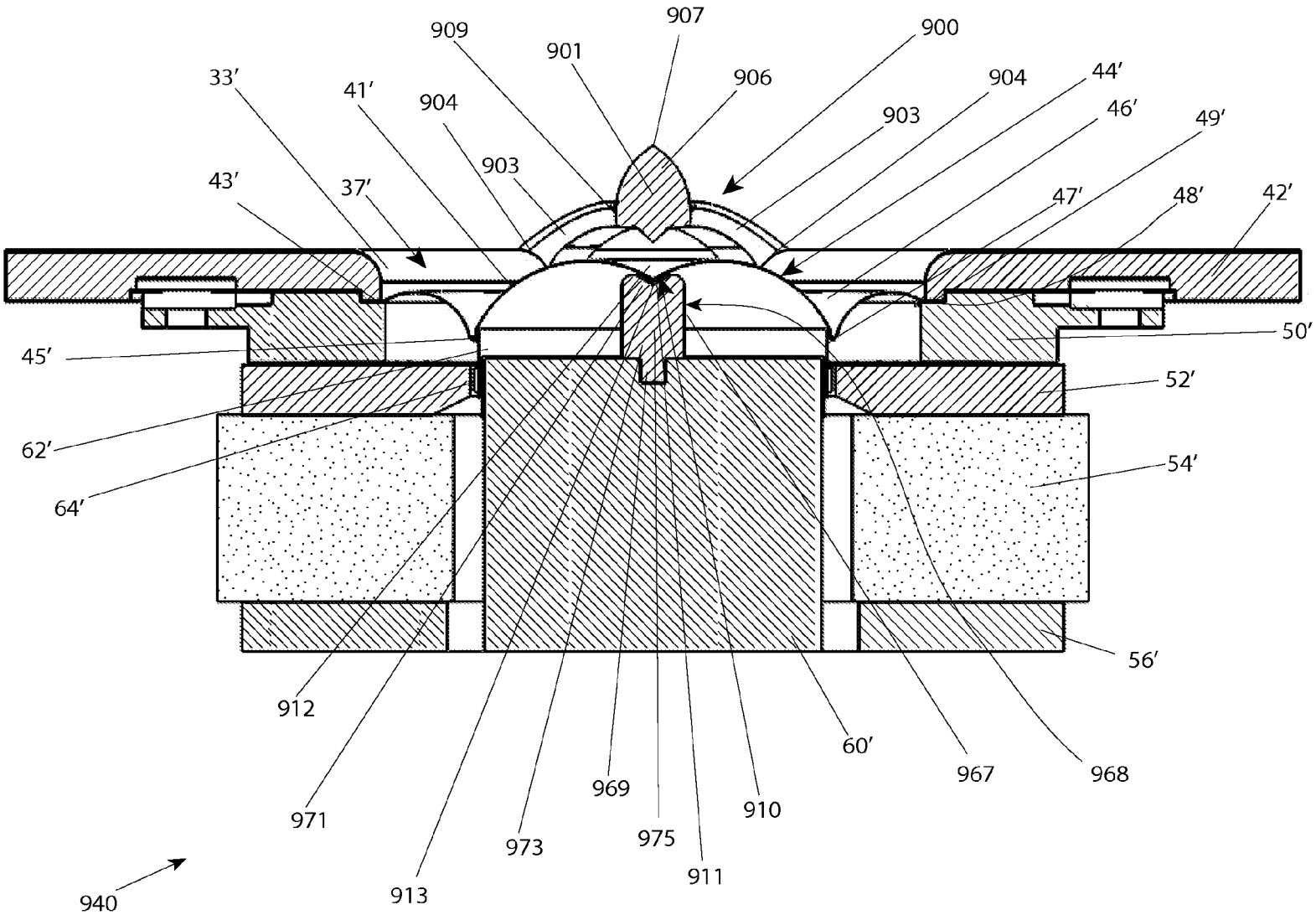
FIG. 9*c* is a cross-section front view of the alternate embodiment of the invention of FIG. 9*a;*
Figure 9D:
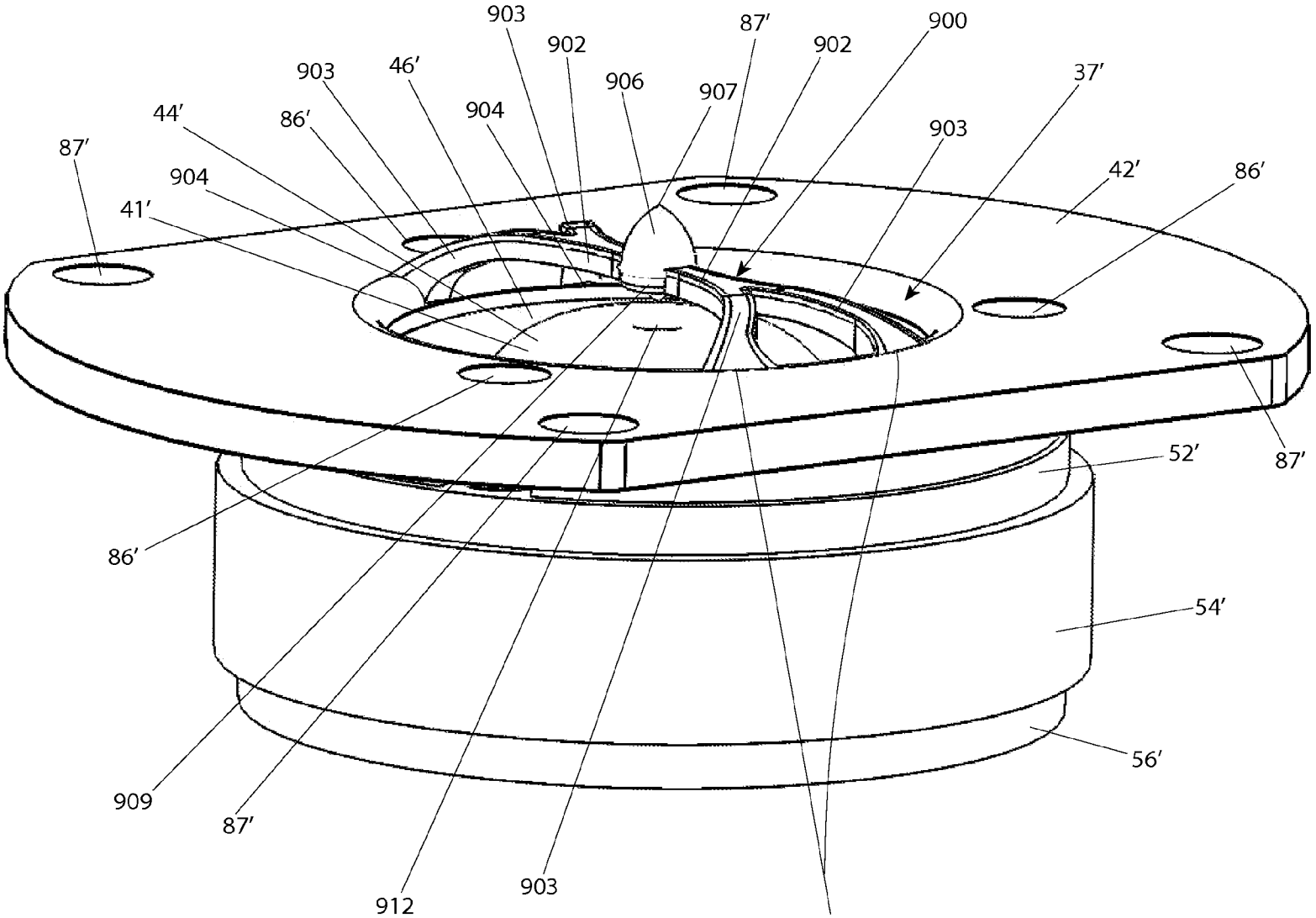
FIG. 9*d* is a perspective view of the alternate embodiment of the invention of FIG. 9*a;*
Figure 9F:
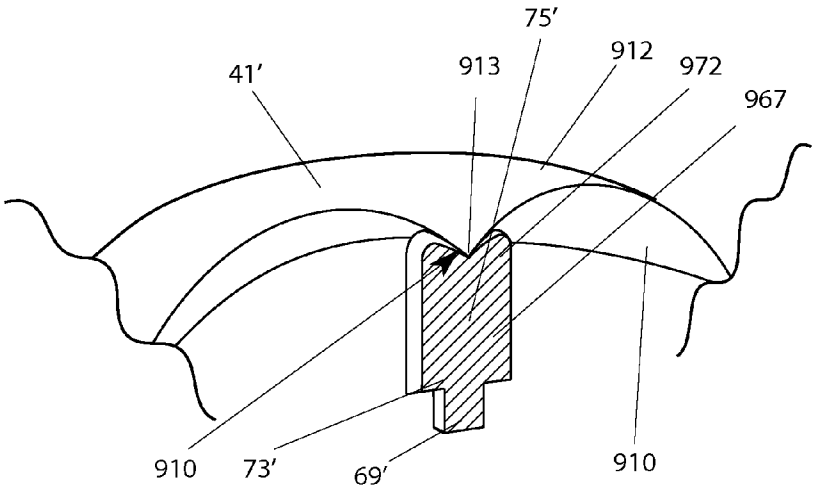
FIG. 9*f* is an enlarged cross-section perspective view of the inner stabilizing member and a part of the central diaphragm portion of the alternate embodiment of the invention of FIG. 9*a;*
Figure 9E:
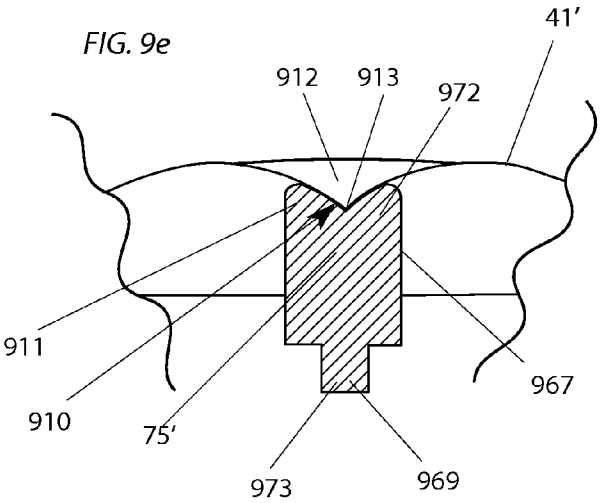
FIG. 9*e* is an enlarged cross-section front view of an inner stabilizing member and a part of the central diaphragm portion of the alternate embodiment of the invention of FIG. 9*a;*

As further shown and described in connection with FIGS. 9*e*-*g*, the interior axially-aligned internal stabilizer member 968 preferably comprises a central portion, or post, 75', and extends integrally via a keyed attachment member 969 thereof from the center of the yoke 60'. The outer wall surface 967 of the stabilizing member 968 is cylindrical, as is the outer wall surface of the keyed attachment member 969. The internal stabilizer member 968 further comprises an upper proximal end portion 971, or integral cap 971, having a hyperbolic-funnel-shaped upper surface 911 for engaging the underside or lower surface 910 of a dimpled portion 912 of the central dome 41'. The hyperbolic funnel portion of the hyperbolic-funnel-shaped upper surface 911 is designated in the drawings as 972. The hyperbolic-funnel-shaped upper surface 911 comprises a partial torus-shaped upper surface combined with a hyperbolic-funnel-shaped inner surface that extends from the uppermost portion of the partial torus portion of the upper surface 911 to an inner central point, or inner small circle, portion 913 of the upper surface 911.

The upper surface 911 of the stabilizing member 968 is fixed, as by gluing, to the interior surface 910 of the central diaphragm portion 41' adjacent the center of the central diaphragm where the proximal end 971 of the stabilizing member is attached to the central diaphragm 41' to form a dimple in the central diaphragm.

Figure 9H:
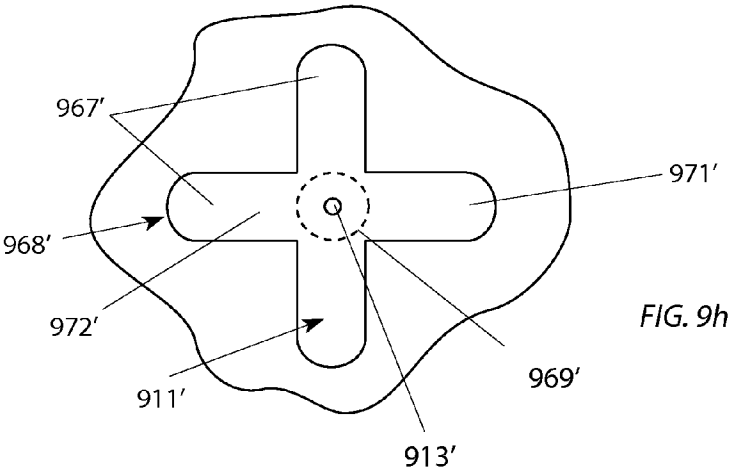
FIG. 9*h* is an enlarged top view of an alternate inner stabilizing member for use with the invention.
Figure 9G:
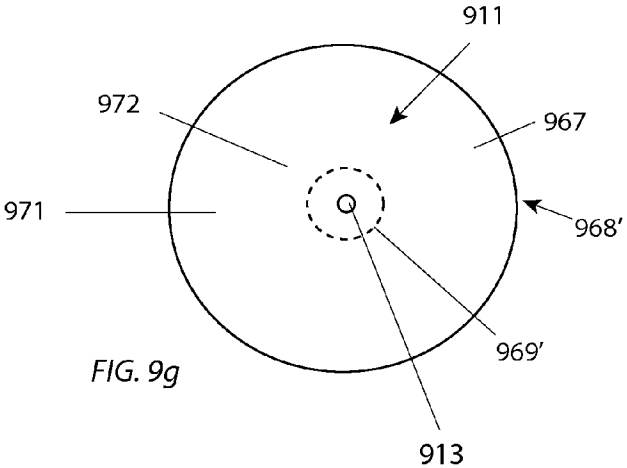
FIG. 9*g* is an enlarged top view of the inner stabilizing member of the alternate embodiment of the invention of FIG. 9*a;*

As shown in FIG. 9*h*, in an alternative embodiment of this aspect of the invention, the stabilizing member 968' is star-shaped, or plus-shaped, in cross-section comprising a plurality of fins 967' and a base member 969' jointly comprised of the keyed attachment member 969' and the upper surface of the yoke or core 60' (partially shown with broken line). The fins 967' terminate in a proximal end 971' of the stabilizing member 968' to form a plurality of upper surfaces 911' that together comprise a plurality of upper surfaces approximately forming the upper portion of a torus shape and that are integral with a corresponding plurality of hyperbolic-shaped lower inner surfaces 972' wherein the lower portions of the hyperbola approach a central point portion, or a small central circle portion 913'. The upper surfaces 911' of the stabilizing member 968' are fixed to the interior surface 910 of the central diaphragm portion 41' adjacent the center of the central diaphragm 41' where the proximal end of the stabilizing member is attached to the central diaphragm to form a dimple 912 in the central diaphragm.

These latter embodiments of the invention illustrate yet other ways of providing for a stabilizing member that is attached to the inner (underside) surface and center of the diaphragm of the loudspeaker in a plane that is different from the outer attachment plane of the periphery of the ring radiator portion of the diaphragm so as to help prevent rocking of the speaker. The attachment of the central dome to the upper surface of the inner axially located stabilizing member having the hyperbolic-partial-torus-funnel-shaped upper surface, which are similar to the inner surface of the bell of a horn, yields attachment surfaces for fixing, as by gluing, the stabilizing member and the diaphragm that are resistant to tearing and other damage often associated with such attachments to the center of a speaker diaphragm. Since the diaphragm of a speaker is flexed many thousands of times during use of the speaker this novel advance in pinning the diaphragm forward (that is in a different, forward, plane) of the attachment plane for the outer periphery of the ring radiator serves to enhance the life of the speaker. Further, the novel bridge structures of these new embodiments of the present invention not only protect the diaphragm from being bumped, as with a vacuum cleaner, book or other device, but also lend to the aesthetics of the loud speaker. Those of ordinary skill in the art will appreciate that the components of the face plates, the bridges and/or central members may all be comprised of an integrally formed and unitary part made of a rigid and durable substance, without departing from the true spirit and scope of the invention.

Referring now to FIGS. 10*a*-10*d*, a loudspeaker system 1040 in accordance with an alternative embodiment of the invention is shown comprising a face plate 42" having a chamfered inner periphery region 33" defining a preferably circular opening 37" for a speaker diaphragm 44" similar to that shown in either FIG. 4*a* or 4*b*. The speaker diaphragm 44" is preferably comprised of an outer-ring radiator portion 46", preferably made of silk or other fabric that is in the shape of an arched strip, in profile. The outer-ring radiator portion 46" has a skirt portion 48" for attaching the outer-ring radiator diaphragm portion, as by gluing, to an upper surface of a diaphragm chassis 50".

As with the prior art, there are attachment locations 43", 45", 47", 49" of diaphragm 44" which lie in a first plane along with the voice coil armature 62". Attachment location 45", 47" includes attachment of outer-ring diaphragm portion 46" being attached, as with gluing for example, near the inner circumference of the outer-ring portion diaphragm portion 46" and near the outer circumference of inner, or central, diaphragm portion 41" by means of a cylindrical, voice coil annular armature 62" upon which is wound the voice coil windings 64" which are free to vibrate between a top plate 52" and yoke 60" of speaker 1040.

The diaphragm chassis 50" for this embodiment resides between the face plate 42" and the annular top plate 52". The annular top plate 52" is adjacent and in contact with annular magnet 54". The yoke 60" extends from a base 56" for attachment with the magnet 54" which, together with top plate 52" forms an annular air gap within which gap armature 62" with voice coil winding 64" thereon is free to move relative to the top plate and yoke in response to electronic stimulus representing sound and against the magnetic field, or magnetic flux, created by the magnet 54" through the top plate and the yoke. Preferably the voice coil 64" and armature 62" move linearly, responsive to the electronic stimulus, along a line that is parallel to the axis of the speaker. Screw holes 86" and 87" are provided through the various portions of the speaker 1040 enabling interconnecting of the speaker portions as is understood by those of ordinary skill in the art of speaker manufacture. Furthermore the general construction of the base 56", yoke 60", magnet 54", top plate 52" and diaphragm chassis 50" so as to allow proper ventilation and functioning of the speaker 1040 are generally understood by those of ordinary skill in the art.

The speaker 1040 of this embodiment of the invention further comprises a bridge member 1000 comprising a plurality (preferably two or three) of forwardly arched extension members 1002, 1003 interconnected at a central intersection location 1007 forward of the central portion 41" of the speaker diaphragm 44", each extension member depending from an attachment location 1004 on the preferably chamfered face plate periphery 33" defining the opening 37". The bridge member 1000 further comprises a ring-shaped, or circular, support member 1008 centered forward of the center of the central portion of the speaker diaphragm 41", the ring-shaped support member interconnecting the plurality of extension members 1002 at an intermediate location along each of the extension members. Thus, the bridge ring-shaped support member 1008 buttresses the extension members 1002 and lends structural strength and stability to the bridge member 1000. Still further, preferably a cross-section of the ring-shaped support member 1008 has a forward-most wide surface and tapers rearwardly and inwardly to a rear-most narrow surface, or point, thus forming a generally v-shaped cross-section which comprises at least an outer taper line which aligns with the circular cross-section intersection of the stabilizing member 76" with the outer surface 53" of the central diaphragm portion.

The bridge member 1000 at least partially spans the opening 37" defined by the face plate 42" for the speaker diaphragm 44". "Partially spans" in this context means that while a portion of the bridge member spans portions of the opening that are not directly lying over a bisecting line, at least a portion of the bridge does pass over, or is positioned over, the center of the central diaphragm.

The loudspeaker 1040 further comprises an exterior axially-located stabilizing member 76" comprising a proximal end 80" and a distal end 78", the distal end of the stabilizing member being attached to the intersection location 1007 of the bridge 1000, and the proximal end engaging the exterior surface 53" of the central diaphragm portion 41" at the center of the central diaphragm where the proximal end of the stabilizing member is attached to the central diaphragm in a second plane parallel to the first plane and that is of sufficient distance from the first plane to provide out-of-axis movement resistance sufficient to stabilize the diaphragm against rocking.

Preferably, the opening 37" defined by the inner periphery 33" of the face plate 42" of the speaker 1040 of this embodiment of the invention is circular and the bridge member 1000 comprises three buttressed arched extension members 1002, each extension member terminating with attachment ends 1004 and having an inner attachment area 1007. Each extension member 1002 depends at the outer attachment ends 1004 from attachment locations 1005 on the inner periphery 33" of the face plate 42" defining the opening 37" for the speaker diaphragm 44", and each extension member 1002 is interconnected to the other extension members (preferably there are three linearly arched extension members that form a single integral bridge unit 1000) at the inner attachment area 1007 of each extension member.

The attachment ends 1004 and attachment locations 1005 are preferably equidistant from each other around the periphery 33' of the opening 37" formed by the face plate 42". Thus, where preferably the opening 37" in the face plate 42" is circular, and where there are three extension members 1002 of the bridge 1000, the attachment locations 1005 would be each 120 degrees from the next closest attachment location. The intersection locations 1007 of each of the extension members 1002 form a portion of the bridge 1000 that is positioned over the center of the center of the central portion 41" of the speaker diaphragm 44".

The exterior axially-aligned stabilizer member 76" preferably extends integrally from the center of the central portion of the bridge 1000 where the plurality of extension members 1002 intersect at 1007. Thus, the axially-aligned stabilizer member 76" is preferably positioned directly over the center of the central diaphragm portion 41" of the diaphragm 44". The outer wall surface 1013 of the exterior axially-aligned stabilizer member 76" may be generally of circular cross section along its length, as in the case of an inverted frustoconical section having a narrower distal end 78" and a wider proximal end 80", or alternatively, the outer wall surface of the axially-aligned stabilizer member may comprise such an inverted frustoconical section that appears to be buttressed by right-angle extensions, or star-shaped fins 1015 of each extension member 1002. Either way, preferably the wider proximal end 80" of the axially-aligned stabilizing member 968' is cylindrical where it interfaces with and is attached, as by gluing, to the upper surface of the central portion 41" of the diaphragm 44".

Preferably extending rearwardly from an underside surface 1016 of the axially aligned stabilizing member 968' is a preferably cylindrical post 1010 that protrudes through a collar 55" in the central diaphragm portion 41". Post 1010 serves to position the central diaphragm portion 41" during installation and use and reinforces attachment of the upper surface of the diaphragm to the underside surface 1016 of the axially aligned stabilizing member 968'. As can be seen in FIGS. 10*b-e*, the central diaphragm portion 41" is dimpled in order to accommodate the downwardly protruding and attached axially aligned stabilizing member.

Figure 10A:
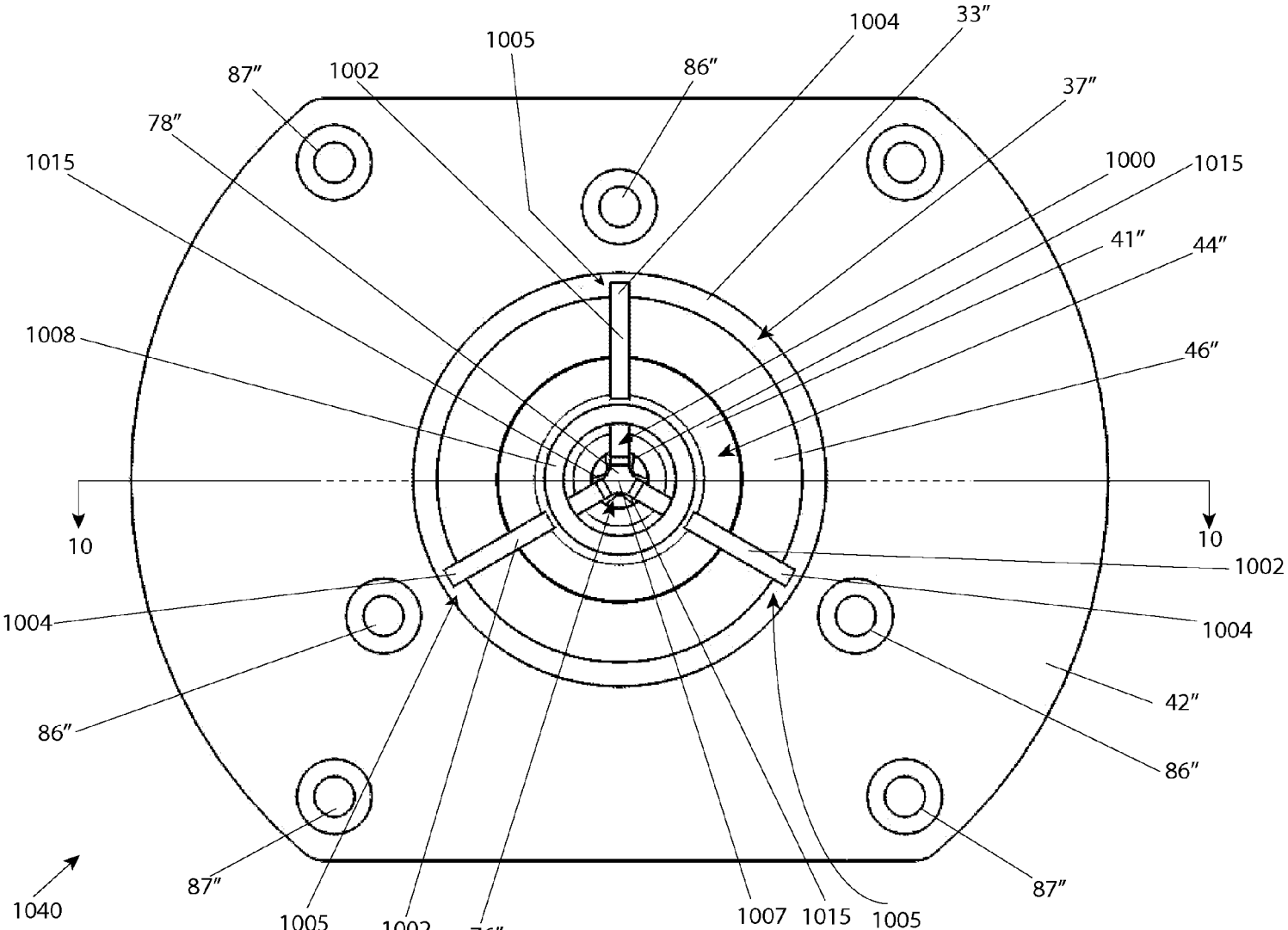
FIG. 10*a* is a top plan view of yet another alternative embodiment of the invention and further comprising another aspect of the invention and showing section line 10-10 for illustrating the location for the sections taken in FIGS. 10*b, c, e* and *f;*
Figure 10B:
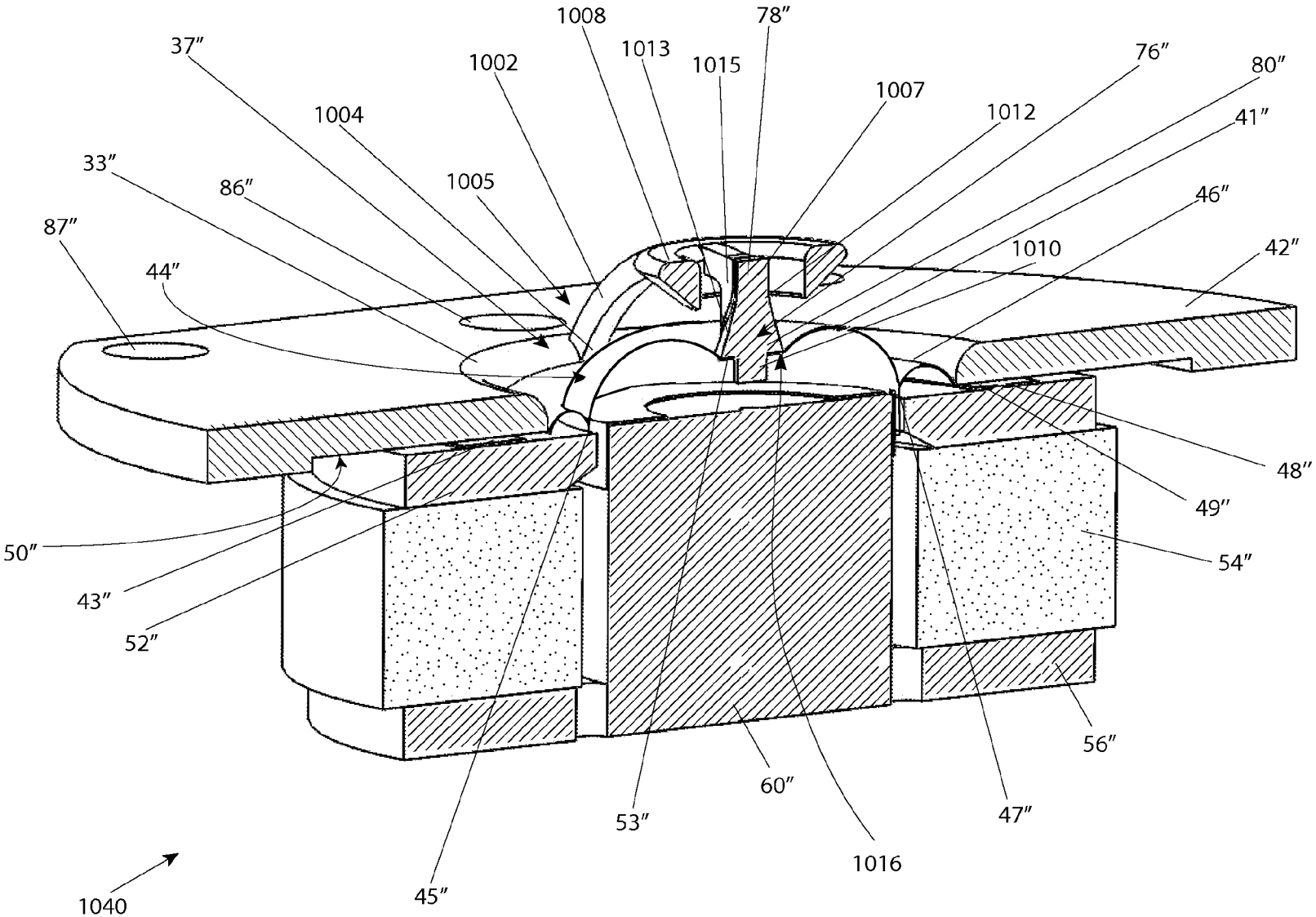
FIG. 10*b* is a cross-section perspective view of the alternate embodiment of the invention of FIG. 10*a;*
Figure 10C:
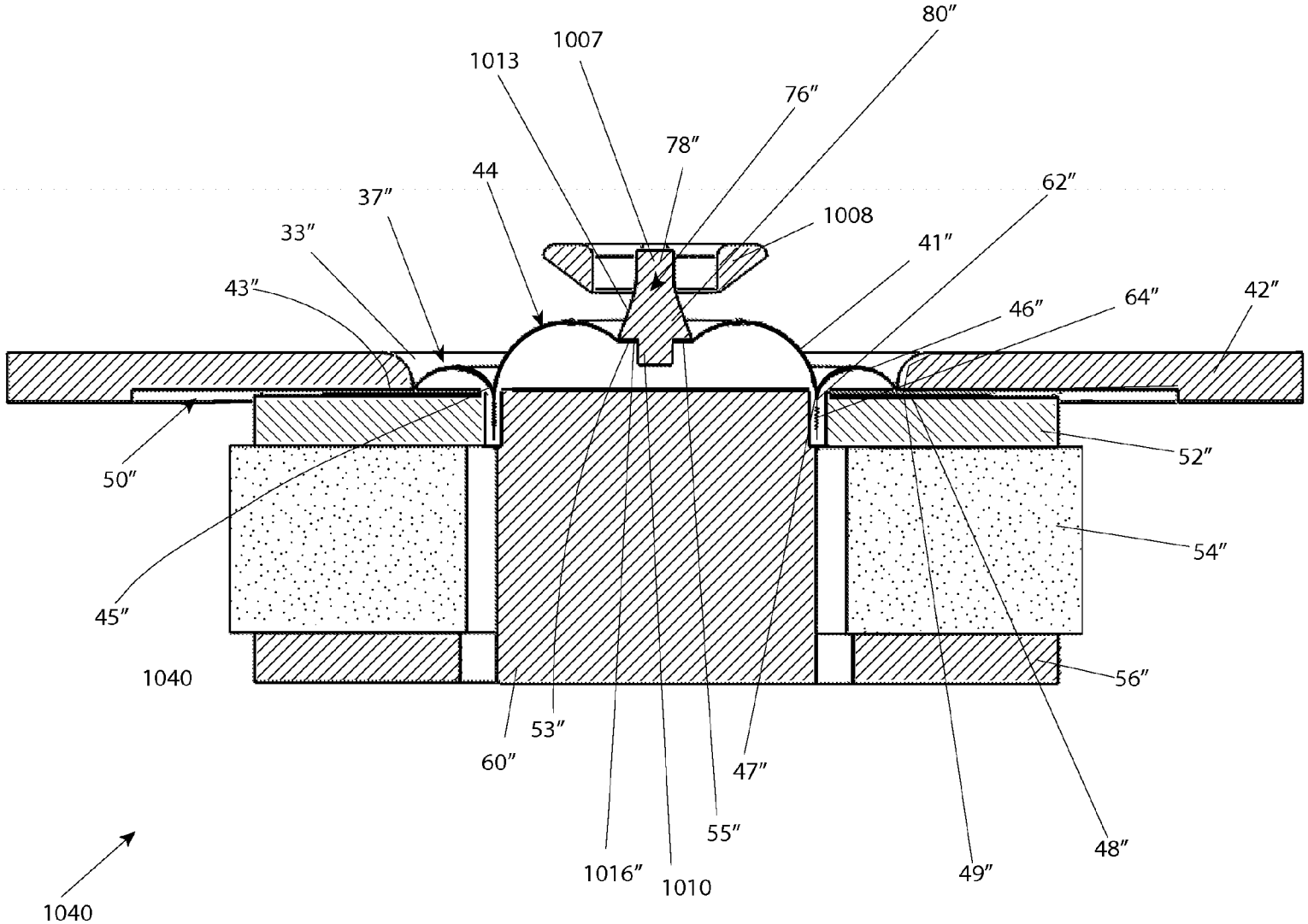
FIG. 10*c* is a cross-section front view of the alternate embodiment of the invention of FIG. 10*a;*
Figure 10D:
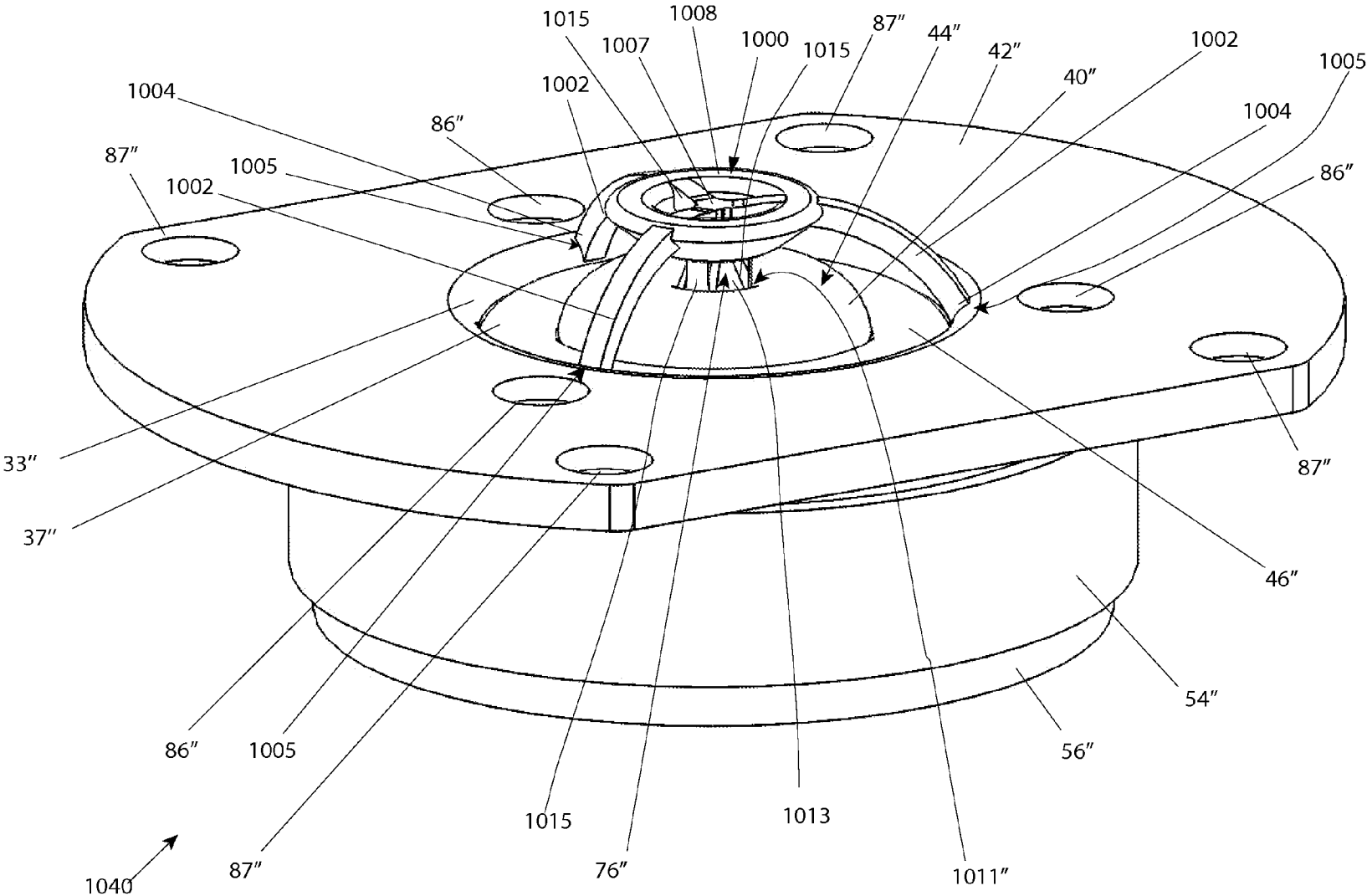
FIG. 10*d* is a perspective view of the alternate embodiment of the invention of FIG. 10*a*.
Figure 10E:
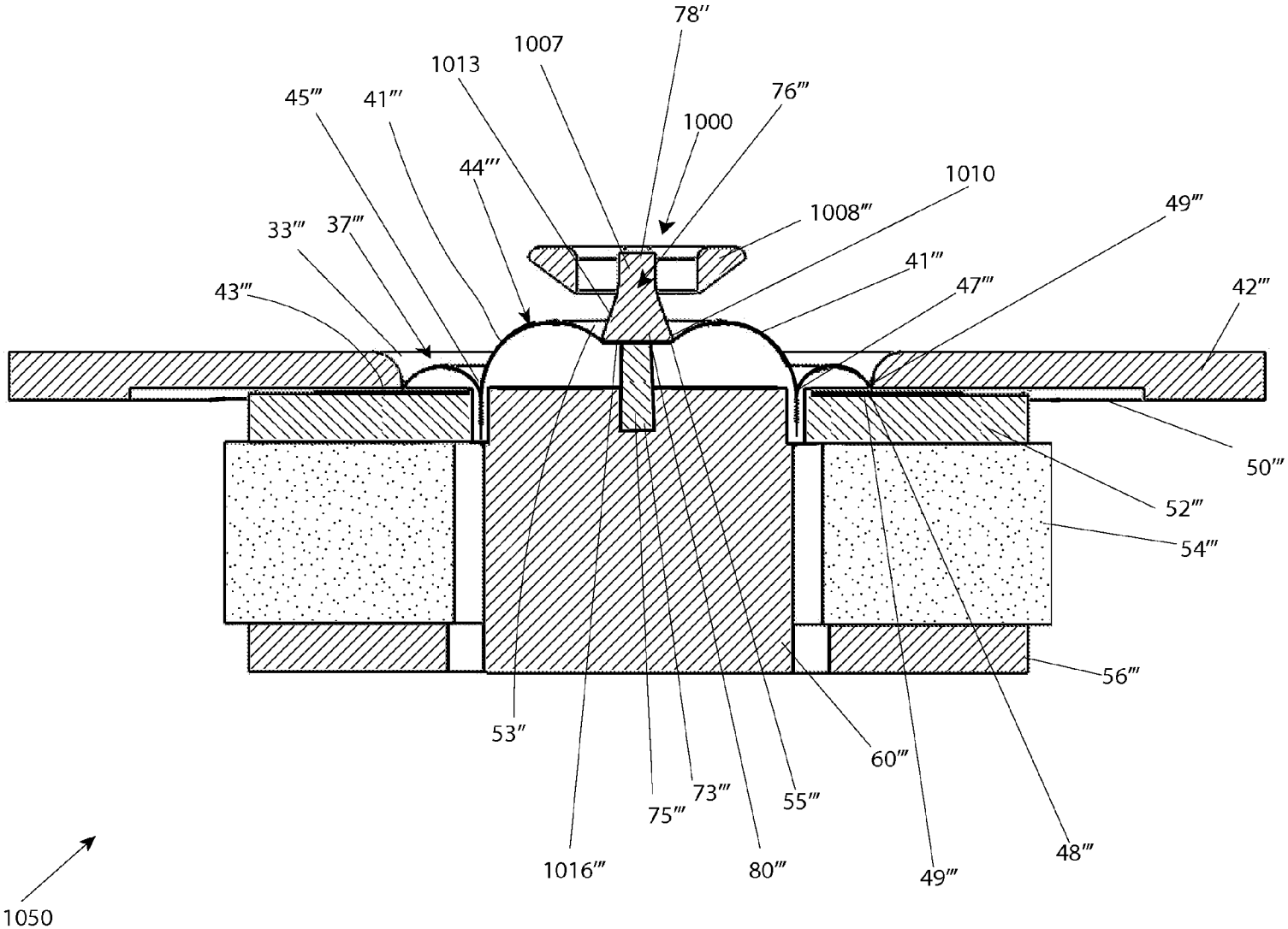
FIG. 10*e* is a cross-section front view of another alternate embodiment of the invention.

Referring now to FIG. 10*e*, there is provided a speaker 1050 that is just like the speaker 1040 in all respects, except that the central diaphragm portion 41'" is also attached, or pinned, from underneath the diaphragm portion with interior axially-extending post 75'" that is keyed to the upper portion of the yoke 60'" similarly as shown and described in connection with FIG. 9*b*.

These latter embodiments of the invention illustrate yet other ways of providing for a stabilizing member that is attached to the bridge 1000 of the loudspeaker 1040, 1050 in a plane that is different from the outer attachment plane of the periphery of the ring radiator portion of the diaphragm so as to help prevent rocking of the speaker. The attachment of the upper surface of the central dome diaphragm 41", 41'" to the lower surface of the exterior axially located stabilizing member, as by gluing, and having post 75", 75'" extend through the collar 55", 55'" in the central diaphragm portion, further serves to stabilize the diaphragm in a different plane than the attachment plane for the outer ring-radiator portion of the diaphragm to the diaphragm chassis. This serves to prevent rocking in the speaker, and this attachment may be further substantiated with the use of the interior axially-aligned stabilizing member 75'" of speaker 1050.

Those of ordinary skill in the art will appreciate that the components of the face plates disclosed herein, the bridges, the central ring member, and/or the external stabilizing members may all be comprised of an integrally formed unitary part that comprises as sufficiently rigid and durable substance as known in the art, without departing from the true spirit and scope of the invention.

The existence of distortion in speaker output has long been known. As is disclosed in *Principles of Loudspeaker Design and Operation*, published by Institute of Radio Engineers (IRE) in a series entitled *Transaction Audio*, p. 124 (1957) it states: "The chief causes of nonlinearity and resulting distortion of the acoustic output in the loudspeaker are nonlinear suspension characteristics and non-uniform distribution of air gap flux." These causes also contribute to rocking which further contributes to distortion in speaker output.

Figure 1A:
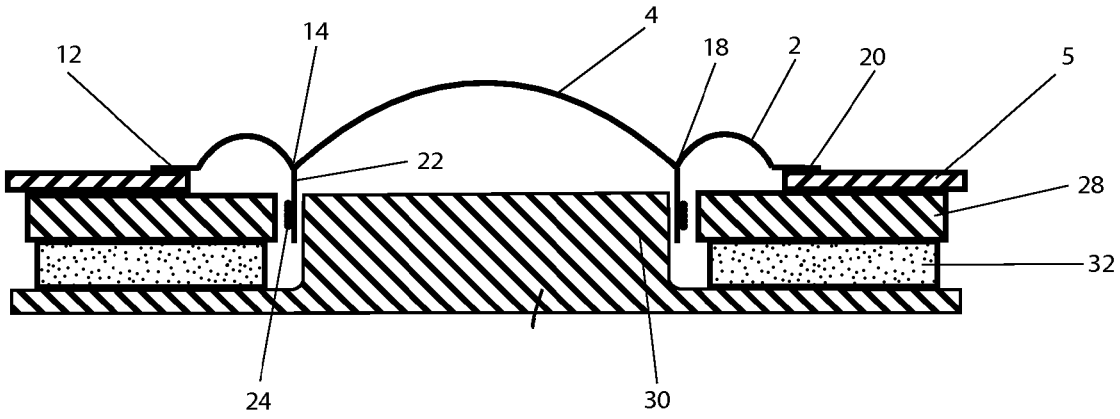
FIG. 1*a* is a front cross-section view of a prior-art speaker system.
Figure 1B:
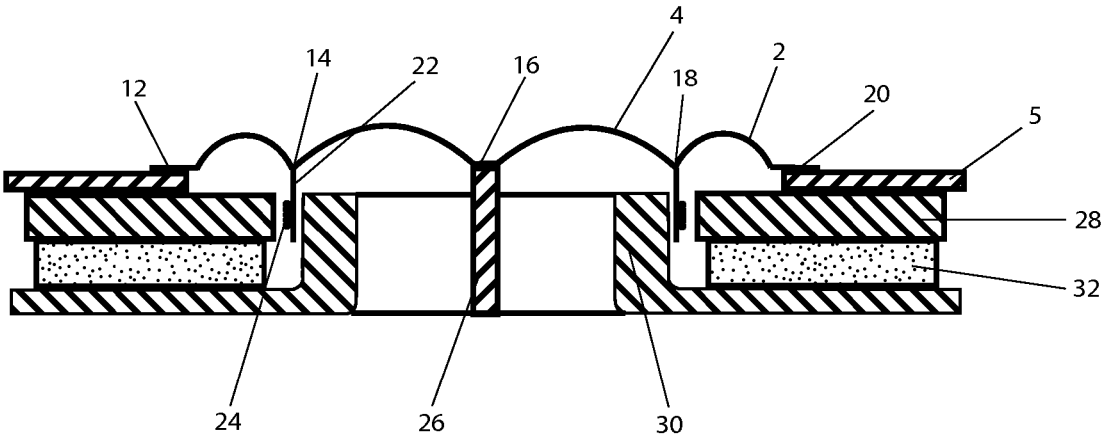
FIG. 1*b* is a front cross-section view of another prior-art speaker system.
Figure 2A:
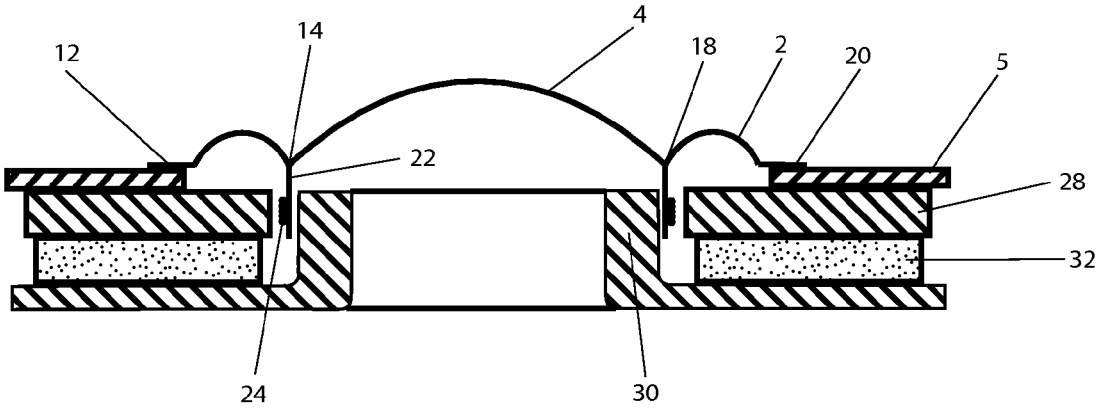
FIG. 2*a* is a front cross-section view of a prior art speaker system at rest.
Figure 2B:
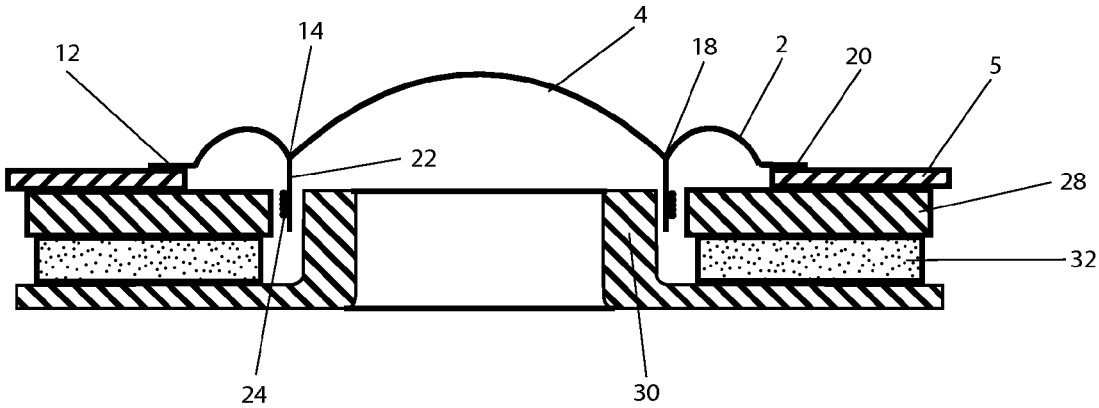
FIG. 2*b* is a front cross-section view of a prior art speaker system at full excursion.
Figure 2C:
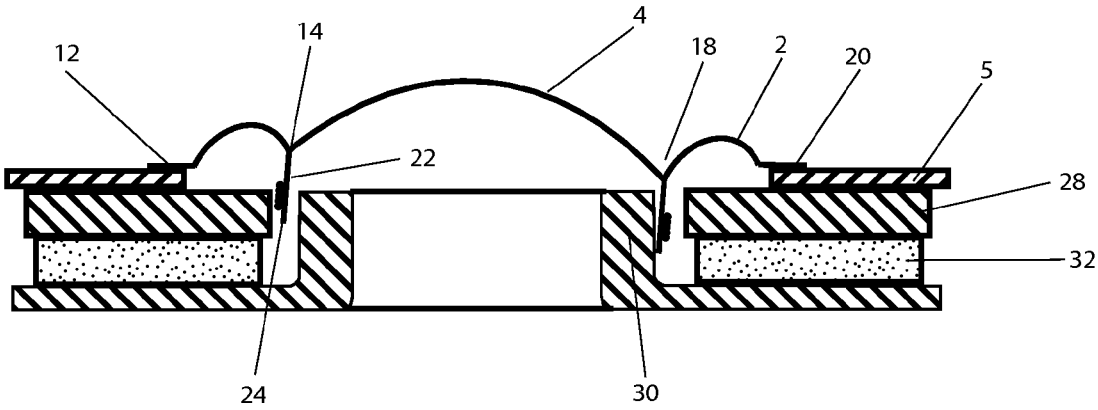
FIG. 2*c* is a front cross-section view of a prior art speaker system in an out-of axis, rocked, position.
Figure 2D:
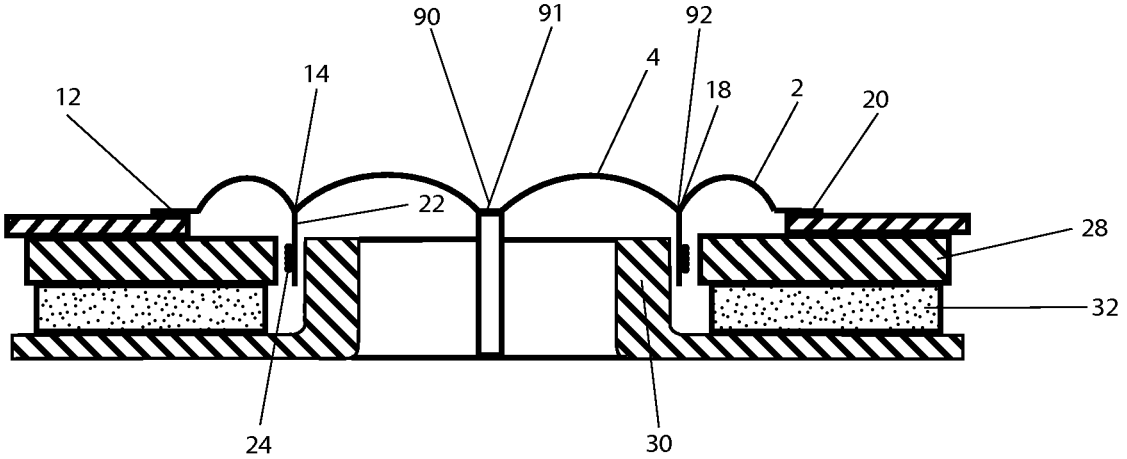
FIG. 2*d* is a front cross-section view of the prior art speaker system of FIG. 1*b* at rest.
Figure 2E:
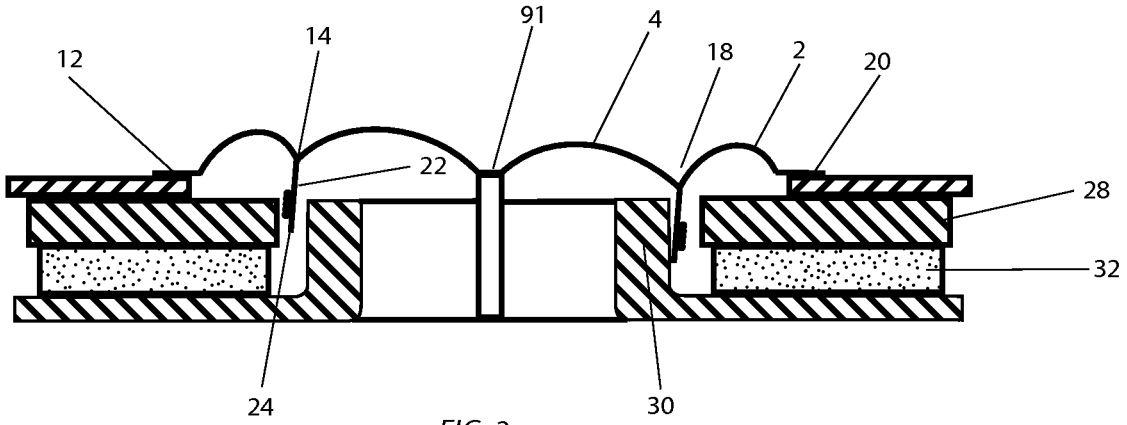
FIG. 2*e* is a front cross-section view of the prior art speaker system of FIG. 1*b* in an-out-of axis, rocked, position.

Similar to that shown in FIGS. 2*c* and 2*e*, where a prior art loudspeaker is shown in a rocked condition, which distorts and translates the diaphragm 4 resulting in distorted speaker output, FIGS. 6 *a-c* illustrate some causes of rocking and FIG. 6 *d* illustrates how such rocking is minimized in the present invention. There is shown in FIGS. 6 *a-c* prior art standard voice coil assemblies or armatures 98 for audio loudspeakers, each armature having shown thereon reference points 104 and 105. Magnetic flux induced in the voice coils 100 by applied audio electrical signals causes each entire armature 98 to move, preferably along an axis 102 inside the fixed magnet assembly (not shown). A diaphragm 107 and 111 (shown partially cut away along the dotted line), and not shown in FIG. 6*a*, would be attached along top edge 101 of the armature 98 and represents a diaphragm, cone, dome, ring radiator or other structure, which is purposefully not shown in FIG. 6*a* to allow for any number of possible or existing prior art structures, is intended to describe a planar connection in FIGS. 6*a* and 6*c*, and a concave connection in FIG. 6*b*, between the motivational forces, e.g., the armature 98 and magnet assembly, and the part of the speaker responsible for moving air to induce sound (diaphragm, cone, dome, ring radiator, etc.)

In an ideal situation, each armature 98 would only transcribe vertical motion along axis 102. Vertical motion 102 on-axis is desirable as it provides the most faithful translation between the electrical signal applied to the voice coils 100 and the resulting sound reproduction.

As previously described, an unintended motion that has been observed in loudspeakers is rocking illustrated with arrows 103 and 108. Rocking may be better understood by considering a point in time where reference point 104 on armature 98 travels ahead of the ideal vertical motion 102 described by the audio signal, while opposing side reference point 105 falls behind the ideal motion described by the audio signal. This, in turn causes unequal pressure to be applied by the diaphragm 107, 111, causing it to stretch and pinch at different points—causing variations in the auto reproduction (distortion).

Rocking is caused by several factors, such as variations of flux density in the air gap surrounding an armature; variations of induced magnetic energy in an armature from small variations in the diameter of the voice coil wire, small variations of the placement of the voice coil wire, changes in the conductivity of voice coil wire, and inconsistencies in energy at the start and end of the magnetic coil; and deformation of voice coil armature material.

Figure 6A:
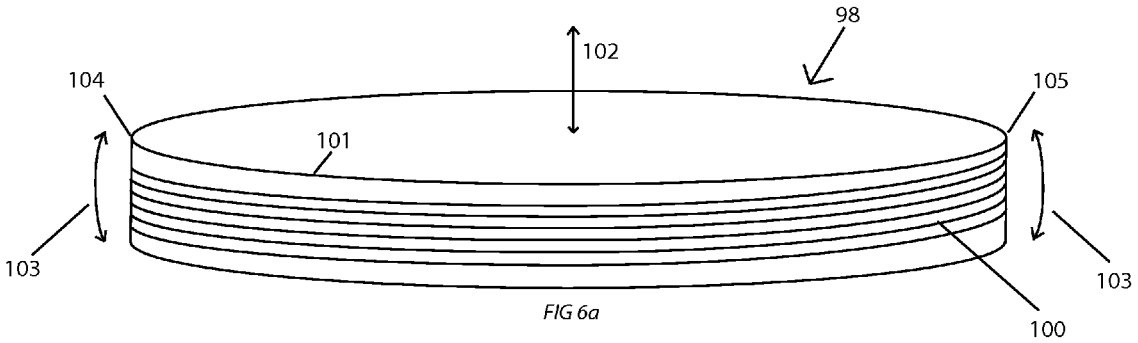
FIG. 6*a* shows a prior art non-stabilized voice coil armature assembly for illustrating normal armature movement as well as rocking caused by unbalanced motivational forces.
Figure 6B:
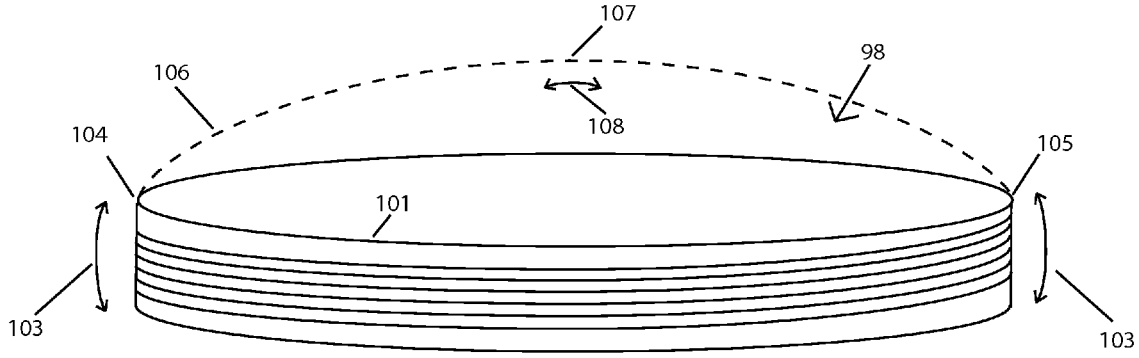
FIG. 6*b* shows a prior art non-stabilized voice coil armature assembly for illustrating that unbalanced motivational forces translate into lateral movement at the top of a dome diaphragm mounted on the armature.

When a dome radiator 106 is attached to armature 98, as shown in FIG. 6*b*, the dome extends above (or below) the plane defined by edge 101. During a rocking condition, it could be observed that the center-top 107 of the dome 106 would be subjected to lateral motion shown at 108 due, for example, to the unequal pressures applied at reference points 104 and 105. This lateral motion is only restricted by the external attachment points, as by gluing, at the outside of the diaphragm along edge 101 and is subject to deformation of the diaphragm material as is likely to occur with non-metallic diaphragms, such as silk, common in usage today.

Figure 6C:
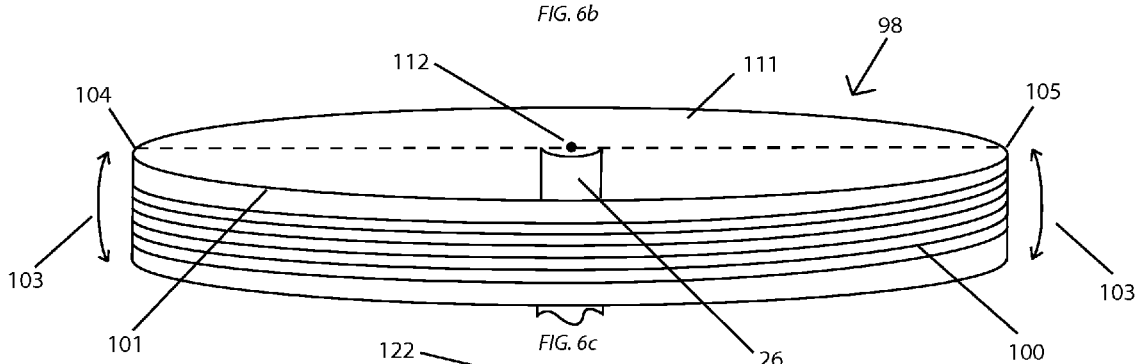
FIG. 6*c* shows a prior art voice coil armature having a diaphragm with an in-plane attachment point for illustrating that torsional forces do not prevent rocking caused by unbalanced motivational forces.

FIG. 6*c* further shows a prior art speaker design with a central post 26 attached to the speaker's stationary chassis and also attached to the center of the diaphragm 111. Since unequal forces of rocking are nearly equal and opposite at reference points 104 (pushing) and 105 (pulling), the resulting forces placed on the stationary attachment point are torsional forces. Thus, the prior art type of in-plane attachment provides little or no resistance to rocking.

Figure 6D:
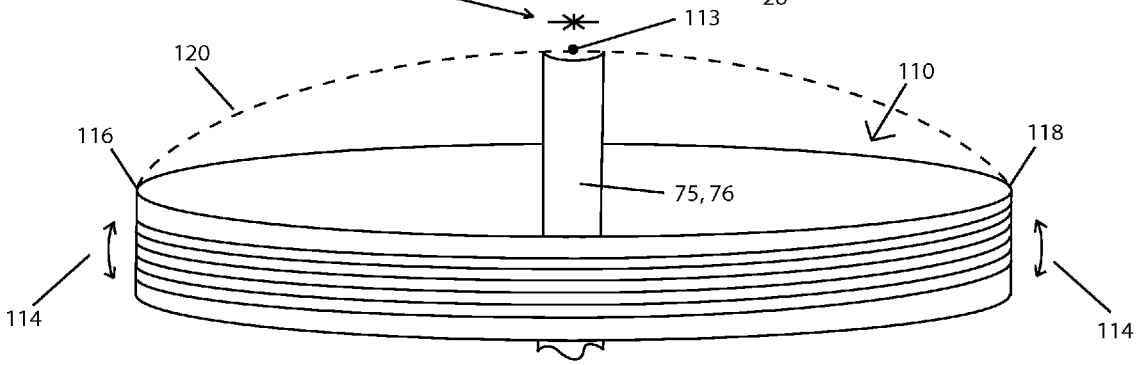
FIG. 6*d* shows a stabilized voice coil armature and dome diaphragm for illustrating that torsional and translational rocking from unbalanced motivational forces are reduced by an out-of-plane attachment of the diaphragm.

FIG. 6*d* shows dome 120 (partially cut away on the dotted line) that is attached at 113 with an out-of-plane attachment in accordance with the several embodiments of the present invention, since each embodiment of the invention involves stabilizing the diaphragm through an axially distant attachment means. Rocking motions/forces 114 shown at reference points 116 and 118 are greatly minimized since though forces 114 would tend to be translated to lateral movement as shown at 108 in FIG. 6*b*, the lateral movement is instead restricted as shown at 122 by the presence of the out-of-axis attachment point 113. Accordingly, the rocking tendency 114 and 122 shown at reference points 116, 118 and 113 are significantly minimized.

Figure 8A:
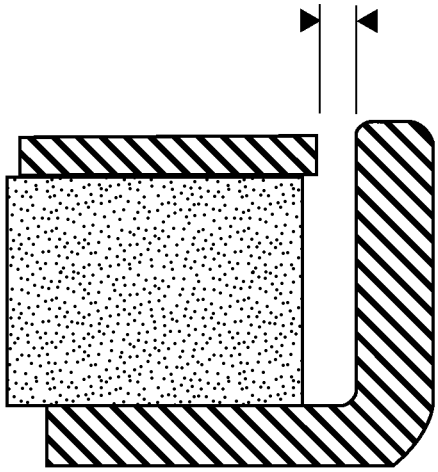
FIG. 8*a* is a cross-section view illustrating a larger width air gap according to prior art.
Figure 8B:
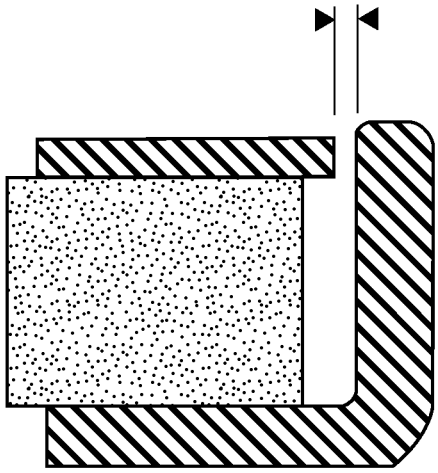
FIG. 8*b* is a cross-section view of a smaller air gap enabled by the present invention.

Because rocking is minimized with the present invention, smaller voice coil air gap widths are enabled, as illustrated in FIGS. 8*a* and 8*b*, since minimization of rocking constrains the voice coil movement to within its intended range of motion. The attachment point of the central diaphragm must be sufficiently distant from the plane of the diaphragm suspension to translate torsional motion from rocking into lateral motion of the diaphragm. In a preferred embodiment, an optimal distance between the first and second planes is 0.25 X diameter of the voice coil armature. Greater separations will add greater resistance to rocking. However, it will be apparent to those of ordinary skill in the art that increasing this distance too far would degrade speaker performance for reasons other than rocking. Conversely, a decrease in this distance diminishes potential lateral forces until the inhibition of rocking becomes insignificant as the second plane of attachment is too close to the first plane of suspension to yield any appreciable benefit as shown in FIG. 6*c*. For this translation to take place and produce a speaker performance improvement, the distance of the central attachment point may range from between 15 to 40 percent out of plane as compared to the central dome diameter. However, it will be appreciated by those of ordinary skill in the art that minor variations from and decreasing the lower end of this range distance, 15 percent out of plane, falls within the scope of the appended claims where the distance out of plane serves to minimize rocking to any degree that would enhance speaker performance. Further, any variation from and increasing this upper range distance, 40 percent out of plane, also falls within the scope of the appended claims.

As is disclosed in *Principles of Loudspeaker Design and Operation*, published by Institute of Radio Engineers (IRE), in a series entitled *Transaction Audio*, p. 124, lines 1-6 (1957) it states: "[T]he greater the flux density, the more efficient the conversion of energy . . . . [A] high flux density also improves electromagnetic damping which serves to suppress the mechanical resonant frequency . . . ." It is also well known to those of ordinary skill in the art that increasing magnetic flux density and motivational force improves speaker performance and speaker dampening.

Figure 7A:
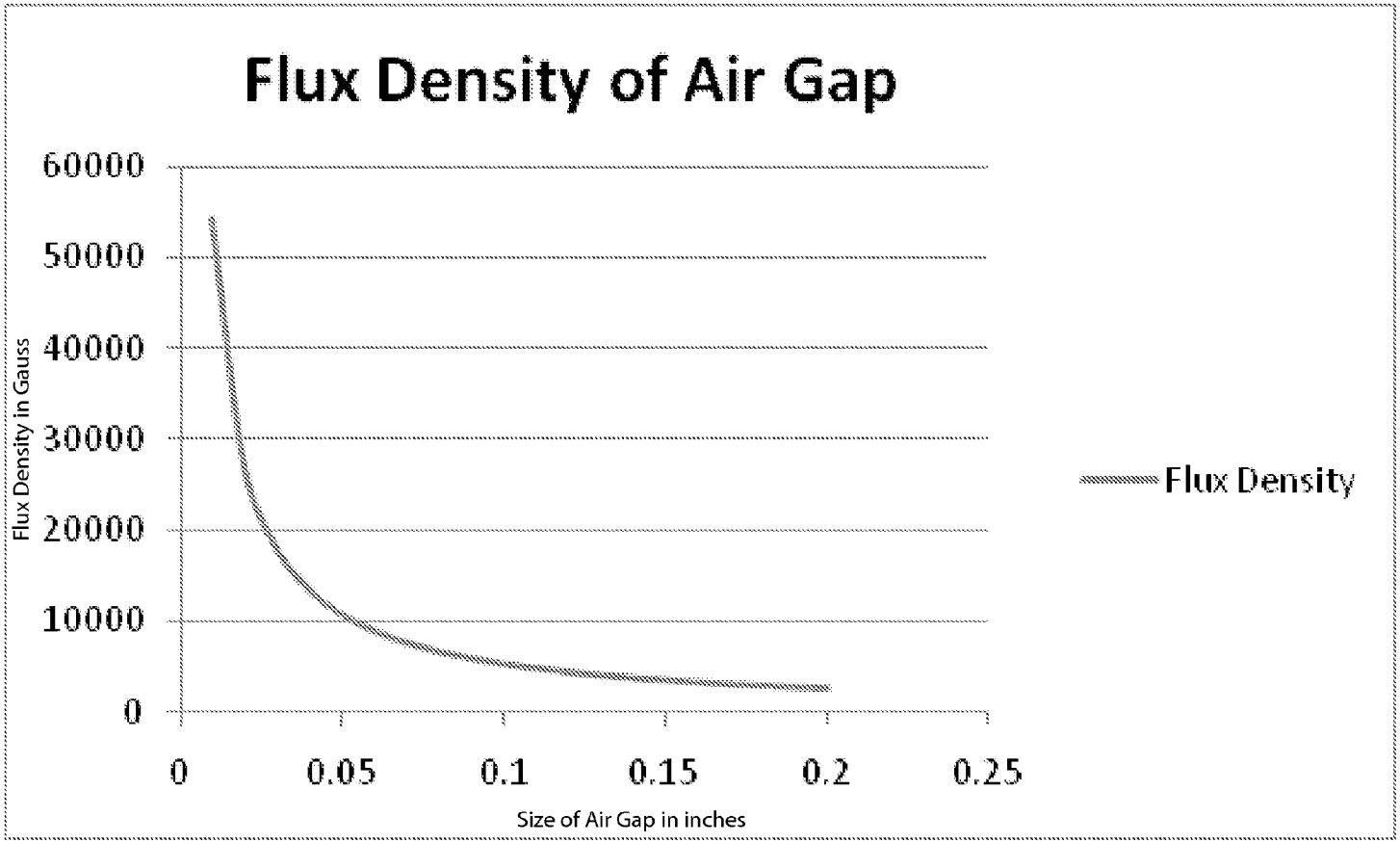
FIG. 7*a* is a graph illustrating the relationship between flux density and air gap width in Gauss.

It is well known by those of ordinary skill in the art that smaller gap widths increase the flux density in the air gap for a given magnetic circuit as shown in FIG. 7*a* and according to the following formula:

$$\beta_g=(H_m \cdot L_m)/L_g$$

where βg is the flux density in the air gap in gauss, Lm is the length of the magnet in inches, Hm is the magnetic force in ampere turns per inch and Lg is the air gap width in inches.

Figure 7B:
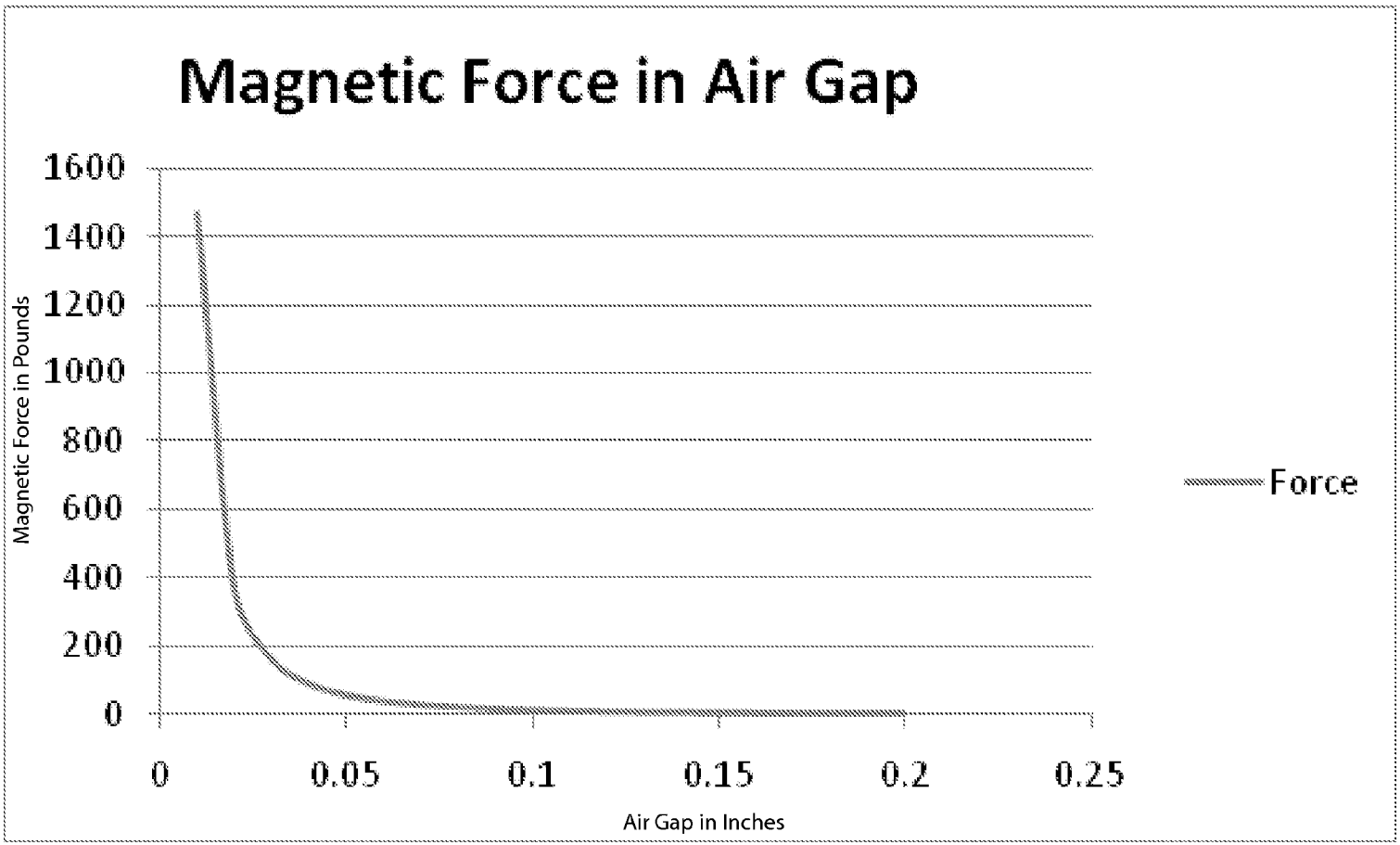
FIG. 7*b* is a graph illustrating the relationship between magnetic force and air gap width.

Similarly, it is well known that an increase in magnetic flux causes an increase in the resulting available force against which the voice coil can push as shown in FIG. 7*b* and according the following formula:

$$F=0.0577 \cdot \beta 13^2 A$$

where F is the Force in pounds, β is the flux density in kilogauss and A is the pole area in square inches.

Therefore, an axially non-planar stabilized, preferably ring-radiator type, loudspeaker in accordance with the present invention offers improved frequency response characteristics, improved transient response, improved efficiency, improved reliability and greater tolerance to resonant frequency limitations of loudspeakers.

The materials for manufacture of the loud speakers herein are preferably as follows and, except where otherwise noted, in accordance with those materials traditionally used in the loudspeaker design and manufacturing art: the top plates and yokes are preferably made of steel or any other material with high magnetic permeability. The diaphragm chassis are preferably made of aluminum. The magnets may be made of ferrite, alnico (aluminum, nickel, cobalt), iron boron, or other rare earth elements known to improve flux, etc. The face plates and bridge members are preferably made of aluminum or other material with non-magnetic properties. The inner and outer diaphragm portions are preferably made of woven and layered silk or other material known to those of ordinary skill in the art. The stabilizing support members, and their subcomponents rib supports, bases and the internal axially-aligned stabilizer, are preferably made of plastic. Likewise, the T-shaped exterior stabilizer support portion or member is also preferably made of plastic.

While several preferred embodiments of the present invention has been shown and described, it will be apparent to those skilled in the art that many changes and modifications may be made without departing from the invention in its broader aspects. For example, it will be appreciated that in its broadest aspect, the invention comprises any means of attaching a central portion of a loudspeaker diaphragm to a stabilizer member in a plane forward or rearward of the plane of attachment of the periphery of the diaphragm to allow the application of leverage to prevent rocking of the sound reproducing portions of the diaphragm. The appended claims are therefore intended to cover all such changes and modifications as fall within the true spirit and scope of the invention.

What is claimed is:

1. An improved loudspeaker comprising diaphragm chassis, top plate, magnet, yoke, voice coil armature, the top plate and yoke defining an annular air gap for the voice coil armature, a face plate comprising an inner periphery defining an opening for a speaker diaphragm having a central diaphragm portion having inner and outer surfaces, a central area and an outer periphery, and an outer annular arch-profiled strip diaphragm portion having an outer periphery and an inner periphery, the central diaphragm portion being attached along the outer periphery of the central diaphragm portion to one of the voice coil armature and the inner periphery of the outer diaphragm portion, the outer periphery of the outer diaphragm portion being attached to the diaphragm chassis in a first plane, wherein the improvement comprises:

a bridge member at least partially spanning the opening in the face plate and comprising a plurality of forwardly arched extension members interconnecting at a central intersection forward of the central diaphragm portion of the speaker diaphragm, each extension member depending from an attachment location on the face plate periphery defining the opening and that is equidistant from a next attachment location of an extension member around the periphery of the face plate;

a ring-shaped support member centered forward of the central area of the central diaphragm portion of the speaker diaphragm, said ring-shaped support member interconnecting the plurality of extension members at an intermediate location along each of the extension members;

a stabilizing member further comprising one of a support member having a plurality of fins, a support member that is star-shaped in cross section, a support member that is plus-shaped in cross-section, a support member that has an inverted frustoconical shape in cross-section, a support member having integral support ribs, and a support member that has a finned inverted frustoconical shape in cross-section, said stabilizing member further comprising a proximal portion and a distal portion, the distal portion of said stabilizing member being attached to the central intersection location of the extension members of said bridge member and the proximal portion of said stabilizing member being attached to the central area of the central diaphragm portion in a second plane parallel to the first plane and that is of sufficient distance from the first plane to provide out-of-axis movement resistance sufficient to stabilize the diaphragm against rocking.

2. The loudspeaker of claim 1, wherein the opening defined by the periphery of the face plate is circular and wherein said bridge member comprises three extension members each of equal length and depending from equidistant attachment locations around the periphery of the opening formed by the face plate.

3. The loudspeaker of claim 1, wherein said central diaphragm portion further comprises a central opening in the central area of the central portion of the speaker diaphragm, and wherein said stabilizing member comprises an axially central, stepped-down post having a first circular cross-section larger diameter for interconnecting between the central intersection of said bridge member and a portion of the outer surface of the central diaphragm portion and a second circular cross-section smaller diameter for extending through the central opening in the central diaphragm portion.

4. An improved loudspeaker comprising diaphragm chassis, top plate, magnet, yoke, voice coil armature, the top plate and yoke defining an annular air gap for the voice coil armature, a face plate comprising an inner periphery defining an opening for a speaker diaphragm having a central portion having inner and outer surfaces, a central area and an outer periphery, and an outer annular arch-profiled strip diaphragm portion having an outer periphery and an inner periphery, the central diaphragm portion being attached along the outer periphery of the central diaphragm portion to one of the voice coil armature and the inner periphery of the outer diaphragm portion, the outer periphery of the outer diaphragm portion being attached to the diaphragm chassis in a first plane, wherein the improvement comprises:

a bridge member at least partially spanning the opening in the face plate and comprising a plurality of forwardly arched extension members interconnecting at a central intersection forward of the central portion of the speaker diaphragm, each extension member depending from an attachment location on the face plate periphery defining the opening and that is equidistant from a next attachment location of an extension member around the periphery of the face plate;

a ring-shaped support member centered forward of the central area of the central portion of the speaker diaphragm, said ring-shaped support member interconnecting the plurality of extension members at an intermediate location along each of the extension members;

a stabilizing member having a proximal portion and a distal portion, the distal portion of said stabilizing member being attached to the central intersection location of the extension members of said bridge member and the proximal portion of said stabilizing member being attached to the central area of the central diaphragm portion in a second plane parallel to the first plane, wherein said stabilizing member further comprises one of a support member having a plurality of fins, a support member that is star-shaped in cross section, a support member that is plus-shaped in cross-section, a support member that has an inverted frustoconical shape in cross-section, a support member having integral support ribs, and a support member that has a finned inverted frustoconical shape in cross-section, said stabilizing member further comprising proximal and distal ends and having a base, said interior axially-located support member being attached at said interior axially-located support member's distal end to the base, the base depending from the yoke, and the proximal end of said interior axially-located support member engaging the inner surface of the central diaphragm portion adjacent the central area where the proximal end of said stabilizing member is attached to the central diaphragm portion, the proximal end of said stabilizing member being attached adjacent the central area in the second plane that is a sufficient distance from the first plane to provide out-of-axis movement resistance sufficient to stabilize the diaphragm against rocking.

5. An improved loudspeaker comprising diaphragm chassis, top plate, magnet, yoke, voice coil armature, the top plate and yoke defining an annular air gap for the voice coil armature, a face plate having an inner periphery defining an opening for a speaker diaphragm having a central diaphragm portion having an inner surface and an outer surface, a central area and an outer periphery, and an outer annular arch-profiled strip diaphragm portion having an outer periphery and an inner periphery, the central diaphragm portion being attached along the outer periphery of the central diaphragm portion to one of the voice coil armature and the inner periphery of the outer diaphragm portion, the outer periphery of the outer diaphragm portion being attached to the diaphragm chassis in a first plane, wherein the improvement comprises:

a bridge member comprising a plurality of forwardly arched extension members interconnected at a central intersection location forward of the central diaphragm portion of the speaker diaphragm, each extension member depending from an attachment location on the face plate periphery defining the opening, the bridge member at least partially spanning the opening defined by the face plate for the speaker diaphragm;

a centrally located member having a forward pointed end and an aft base portion, the centrally located member being attached to said bridge member at the central intersection location of the extension members and adjacent the aft base portion of the centrally located member;

a stabilizing member comprising a proximal end and a distal end, the distal end of said stabilizing member being attached to one of the yoke and the intersection of the extension members, and the proximal end engaging one of the inner and the outer surface of the central diaphragm portion at the central area of the central diaphragm portion where the proximal end of said stabilizing member is attached to the central diaphragm portion in a second plane parallel to the first plane and that is of sufficient distance from the first plane to provide out-of-axis movement resistance sufficient to stabilize the diaphragm against rocking, wherein the opening defined by the inner periphery of the face plate is circular and wherein said bridge member comprises two y-shaped extension members, each y-shaped extension member comprising two outer legs terminating with attachment ends and an inner leg having an attachment area, each y-shaped extension member depending at the outer attachment ends from attachment locations on the periphery of the face plate defining the opening for the speaker diaphragm and each y-shaped extension member being interconnected to the other y-shaped extension member at an inner attachment area, the inner legs of the y-shaped extension members forming a portion of the bridge that is linear and is positioned over the central area of the central portion of the speaker diaphragm.

6. The loudspeaker of claim 5, wherein said stabilizing member further comprises an interior axially-located and star-shaped support member comprising proximal and distal ends, integral support ribs and a base, said interior axially-located support member being attached at said interior axially-located support member's distal end to the base, the base depending from the yoke, and the proximal end of said interior axially-located support member engaging the inner surface of the central diaphragm portion at the central area of the central diaphragm where the proximal end of said stabilizing member is attached to the central diaphragm.

7. The loudspeaker of claim 6, wherein the proximal end of said stabilizing member further comprises an upper surface that is comprised of a partially torus-shaped upper surface integral with a hyperbolic-shaped lower inner surface wherein the lower portions of the hyperbolic-shaped lower inner surface approach a point, and wherein said upper surface is fixed to the interior surface of the central diaphragm portion adjacent the central area of the central diaphragm where the proximal end of said stabilizing member is attached to the central diaphragm to form a dimple in the central diaphragm.

8. The loudspeaker of claim 6, wherein said stabilizing member is star-shaped in cross-section comprising a plurality of fins and a base member, wherein the fins terminate in a proximal end of said stabilizing member to form a plurality of upper surfaces that together form a partially torus shape and that are integral with a corresponding plurality of hyperbolic-shaped lower inner surfaces wherein the lower portions of the hyperbolic-shaped lower inner surfaces approach a central point, and wherein the upper surfaces are fixed to the inner surface of the central diaphragm portion adjacent the central area of the central diaphragm where the proximal end of said stabilizing member is attached to the central diaphragm to form a dimple in the central diaphragm.

* * * * *